US008158913B2

(12) United States Patent
Zeng et al.

(10) Patent No.: US 8,158,913 B2
(45) Date of Patent: Apr. 17, 2012

(54) MULTIDIRECTIONAL FUSE SUSCEPTOR

(75) Inventors: Neilson Zeng, North York (CA); Laurence M. C. Lai, Mississauga (CA); Scott W. Middleton, Oshkosh, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 1391 days.

(21) Appl. No.: 11/789,898

(22) Filed: Apr. 26, 2007

(65) Prior Publication Data

US 2008/0035634 A1 Feb. 14, 2008

Related U.S. Application Data

(60) Provisional application No. 60/890,037, filed on Feb. 15, 2007, provisional application No. 60/795,320, filed on Apr. 27, 2006, provisional application No. 60/926,183, filed on Apr. 25, 2007.

(51) Int. Cl.

| | |
|---|---|
| ***H05B 6/80*** | (2006.01) |
| ***A21D 13/00*** | (2006.01) |
| ***B32B 15/04*** | (2006.01) |

(52) U.S. Cl. ..... 219/730; 219/728; 426/107; 428/333

(58) Field of Classification Search ..... 219/728, 219/725, 730, 734, 745, 759, 729; 426/107, 426/234, 243; 99/DIG. 14

See application file for complete search history.

(56) References Cited

U.S. PATENT DOCUMENTS

| | | | | |
|---|---|---|---|---|
| 4,775,771 | A | | 10/1988 | Pawlowski |
| 4,865,921 | A | | 9/1989 | Hollenberg |
| 4,890,439 | A | | 1/1990 | Smart |
| 4,936,935 | A | | 6/1990 | Beckett |
| 4,963,424 | A | | 10/1990 | Beckett |
| 5,093,364 | A | | 3/1992 | Richards |
| 5,117,078 | A | * | 5/1992 | Beckett ..... 219/728 |
| 5,213,902 | A | | 5/1993 | Beckett |
| 5,221,419 | A | | 6/1993 | Beckett |
| 5,260,537 | A | | 11/1993 | Beckett |
| 5,266,386 | A | | 11/1993 | Beckett |
| RE34,683 | E | | 8/1994 | Maynard |
| 5,340,436 | A | | 8/1994 | Beckett |
| 5,354,973 | A | | 10/1994 | Beckett |
| 5,410,135 | A | | 4/1995 | Pollart |
| 5,412,187 | A | | 5/1995 | Walters |
| 5,424,517 | A | | 6/1995 | Habeger |
| 5,446,270 | A | | 8/1995 | Chamberlain |
| 5,489,766 | A | | 2/1996 | Walters |
| 5,519,195 | A | * | 5/1996 | Keefer et al. ..... 219/728 |
| 5,530,231 | A | | 6/1996 | Walters |
| 5,628,921 | A | | 5/1997 | Beckett |
| 5,672,407 | A | | 9/1997 | Beckett |
| 5,759,422 | A | | 6/1998 | Schmelzer |
| 5,800,724 | A | | 9/1998 | Habeger |

(Continued)

FOREIGN PATENT DOCUMENTS

WO WO 01/23275 A1 4/2001

*Primary Examiner* — Quang Van

(74) *Attorney, Agent, or Firm* — Womble Carlyle Sandridge & Rice, LLP

(57) ABSTRACT

A susceptor structure includes a layer of conductive material supported on a non-conductive substrate. The conductive layer includes a resonant loop defined by a plurality of microwave energy transparent segments and, optionally, a microwave energy transparent element within the resonant loop.

58 Claims, 11 Drawing Sheets

U.S. PATENT DOCUMENTS

| | | | | |
|---|---|---|---|---|
| 6,114,679 | A | 9/2000 | Lai | |
| 6,133,560 | A * | 10/2000 | Zeng et al. | 219/730 |
| 6,150,646 | A | 11/2000 | Lai | |
| 6,204,492 | B1 | 3/2001 | Zeng | |
| 6,251,451 | B1 | 6/2001 | Zeng | |
| 6,414,290 | B1 * | 7/2002 | Cole et al. | 219/759 |
| 6,433,322 | B2 | 8/2002 | Zeng | |
| 6,455,827 | B2 | 9/2002 | Zeng | |
| 6,501,059 | B1 | 12/2002 | Mast | |
| 6,552,315 | B2 | 4/2003 | Zeng | |
| 6,677,563 | B2 | 1/2004 | Lai | |
| 6,717,121 | B2 | 4/2004 | Zeng | |
| 6,765,182 | B2 | 7/2004 | Cole | |

* cited by examiner

MULTIDIRECTIONAL FUSE SUSCEPTOR

CROSS-REFERENCE TO RELATED APPLICATIONS

This application claims the benefit of U.S. Provisional Application No. 60/795,320, filed Apr. 27, 2006, U.S. Provisional Application No. 60/890,037, filed Feb. 15, 2007, and U.S. Provisional Application No. 60/926,183, filed Apr. 25, 2007, each of which is incorporated by reference herein in its entirety.

TECHNICAL FIELD

The present invention relates generally to microwave energy interactive structures and, more particularly, the present invention relates generally to microwave energy interactive structures that are capable of heating, browning, and/or crisping an adjacent food item.

BACKGROUND

The use of susceptors in food packaging for microwavable food items is well known to those in the art. The susceptor converts microwave energy to thermal energy, which then can be transferred to an adjacent food item. As a result, the heating, browning, and/or crisping of the food item can be enhanced. With a conventional plain susceptor film, there is a random flow of current under microwave energy radiation. The magnitude of the current flow depends on the surface resistance of the susceptor, which is related to the random distribution of fine metallic spots and the E-field strength applied to the sheet. If the magnitude of the current is high enough, or a susceptor is used in a package without a uniform food load, the susceptor film may overheat at one or more regions and cause crazing or shrinking of the susceptor film. As a result, the ability of the susceptor to generate heat is diminished. Thus, there is a need for a microwave energy interactive structure that enhances heating, browning, and/or crisping of an adjacent food item while being resistant to burning, crazing, and scorching.

SUMMARY

According to the present invention, a susceptor structure is provided with a plurality of microwave energy transparent areas that reduce or prevent large scale random current flow. The microwave energy inactive areas are arranged as a pattern of segments that define a plurality of generally interconnected shapes. In one exemplary embodiment, a microwave energy transparent element is substantially centrally located within each shape.

In one aspect, the interconnected shapes are dimensioned to create a resonant effect in the presence of microwave energy. The resonant effect of the interconnected shapes provides uniform power distribution and, therefore, uniform heating, across the structure.

In another aspect, the interconnected shapes form a "multidirectional fuse". The multidirectional fuse includes a plurality of selectively arranged microwave energy transparent areas that limit the random flow of current and random crazing typically observed with conventional susceptor structures.

As a result of these and other aspects, the susceptor structure of the invention is less susceptible to crazing, and therefore, is less susceptible to premature failure. As such, the susceptor structure of the invention can withstand higher power levels and has a greater useful life, while still having an innate ability to self-limit or "shut down" to avoid undesirable overheating.

In one particular aspect, the invention is directed to a susceptor structure comprising a layer of conductive material supported on a non-conductive substrate, where the conductive layer includes a resonant loop defined by a plurality of microwave energy transparent segments and a microwave energy transparent element within the resonant loop. The resonant loop may be substantially hexagonal in shape or may have any other suitable shape, and may be formed from side segments and corner segments.

In one variation, the side segments of the resonant loop have a substantially rectangular shape. In another variation, the side segments of the resonant loop may have a first dimension of about 2 mm and, optionally, a second dimension of about 0.5 mm. In another variation, the corner segments have a substantially tri-star shape.

In still another variation, the microwave energy transparent element within the resonant loop is substantially cross-shaped. The microwave energy transparent element within the resonant loop may comprise a pair of orthogonally overlapping, substantially rectangular microwave energy transparent segments. Each of the substantially rectangular microwave energy transparent segments may have an overall first dimension of about 2 mm and an overall second dimension of about 2 mm. If desired, the microwave energy transparent element within the resonant loop may be substantially centered within the resonant loop. The resonant loop may have a perimeter of about 60 mm.

In another aspect, the invention is directed to a susceptor structure comprising a plurality of microwave energy transparent segments within a layer of microwave energy interactive material and a substantially cross-shaped microwave energy transparent element substantially centered within the hexagonal loop. The microwave energy transparent segments are arranged in the shape of a hexagonal loop.

In one variation, the plurality of microwave energy transparent segments may include segments that form sides of the hexagonal loop and segments that form corners of the hexagonal loop. In another variation, the segments that form sides of the hexagonal loop have a first dimension of about 2 mm and a second dimension of about 0.5 mm, the corner segments are substantially tri-star in shape, the cross-shaped element substantially centered within the hexagonal loop has a first overall dimension of about 2 mm and a second overall dimension of about 2 mm, and the perimeter of the hexagonal loop is about 60 mm.

In yet another aspect, the invention is directed to a susceptor structure comprising a layer of conductive material supported on a non-conductive substrate. The conductive layer includes a plurality of spaced apart microwave energy transparent segments that define a pattern of interconnected hexagonal loops, and a substantially centrally located microwave energy transparent element within at least one of the loops.

The plurality of spaced apart microwave energy transparent segments may include side segments and corner segments. In one variation, the side segments have a substantially rectangular shape. In another variation, the corner segments have a substantially tri-star shape. The substantially centrally located microwave energy transparent element within at least one of the loops may have a substantially cross shape.

Each of the hexagonal loops may have a perimeter selected to promote resonance of microwave energy along each hexagonal loop. Further, each of the hexagonal loops may have a perimeter selected to promote resonance of microwave energy across the susceptor structure. For example, the perimeter of each of the hexagonal loops may have a perimeter approximately equal to one-half of an effective wavelength of an operating microwave oven.

In a further aspect, the invention is directed to a susceptor structure comprising an electrically continuous layer of conductive material supported on a non-conductive substrate. The susceptor structure includes a repeating pattern of microwave energy transparent areas within the layer of conductive material. The microwave energy transparent areas generally are circumscribed by the layer of conductive material. The repeating pattern includes a plurality of cross-shaped microwave energy transparent elements and a plurality of a microwave energy transparent, segmented hexagonal loops. Each cross-shaped microwave energy transparent element is disposed within one of the segmented hexagonal loops. The hexagonal loops are dimensioned to promote resonance of microwave energy across the susceptor structure. In one variation, the electrically continuous layer of conductive material comprises aluminum, the non-conductive substrate comprises a polymer film, the cross-shaped microwave energy transparent elements each have a first dimension of about 2 mm and a second dimension of about 2 mm, and the hexagonal loops each have a perimeter of about 60 mm.

Other features, aspects, and embodiments will be apparent from the following description and accompanying figures.

BRIEF DESCRIPTION OF THE DRAWINGS

The description refers to the accompanying drawings, some of which are schematic, in which like reference characters refer to like parts throughout the several views, and in which.

DETAILED DESCRIPTION

The present invention may be illustrated further by referring to the figures. For purposes of simplicity, like numerals may be used to describe like features. It will be understood that where a plurality of similar features are depicted, not all of such features necessarily are labeled on each figure. It also will be understood that various components used to form the microwave energy interactive structures of the invention may be interchanged. Thus, while only certain combinations are illustrated herein, numerous other combinations and configurations are contemplated hereby.

Figure 1A:
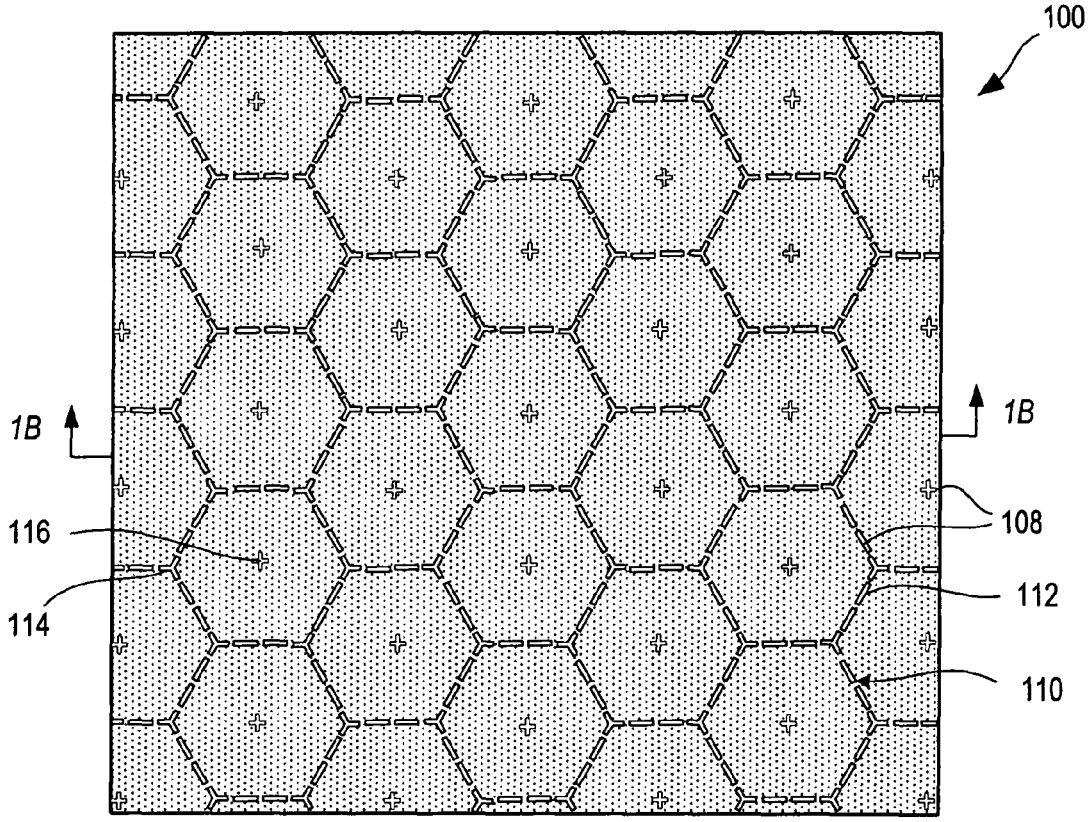
FIG. 1A schematically depicts an exemplary microwave energy interactive structure according to various aspects of the invention.
Figure 1B:
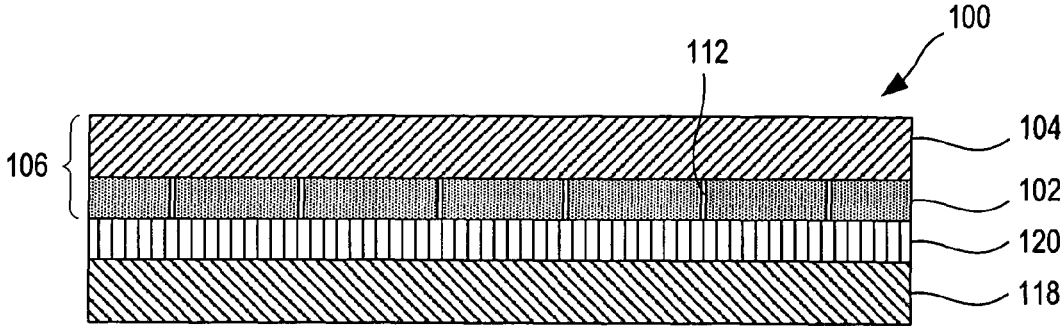
FIG. 1B schematically depicts a cross-sectional view of the structure of FIG. 1A taken along a line 1B-1B.

FIGS. 1A and 1B illustrate an exemplary microwave energy interactive structure 100 according to various aspects of the invention. The structure 100 includes a layer of microwave energy interactive material 102, schematically illustrated using stippling in the figures. The microwave energy interactive material 102 may be deposited on a microwave energy transparent substrate 104 for ease of handling and/or to prevent contact between the microwave interactive material and a food item (not shown). The microwave energy interactive material and substrate collectively form susceptor film 106 (FIG. 1B).

As shown in FIGS. 1A and 1B, the structure 100 includes a plurality of microwave energy inactive or transparent elements or segments (generally "areas") 108 within the layer of microwave energy interactive material 102. The microwave energy interactive material 102, shown by stippling, is generally continuous, except where interrupted by the microwave transparent areas 108, shown in white. Each transparent or inactive area may be a portion of the structure from which microwave energy interactive material has been removed chemically or otherwise, may be a portion of the structure formed without a microwave energy interactive material, or may be a portion of the structure formed with a microwave energy interactive material that has been deactivated chemically, mechanically, or otherwise. Each transparent or inactive area is circumscribed by the microwave energy interactive material (except those segments that abut an edge of the structure).

Some of the microwave energy transparent areas 108 are arranged to form a plurality of interconnecting segmented loops 110. In this example, the segmented loops 110 are substantially hexagonal in shape. However, other shapes, for example, circles, squares, rectangles, pentagons, heptagons, or any other regular or irregular shape may be suitable for use with the invention.

Figure 1C:
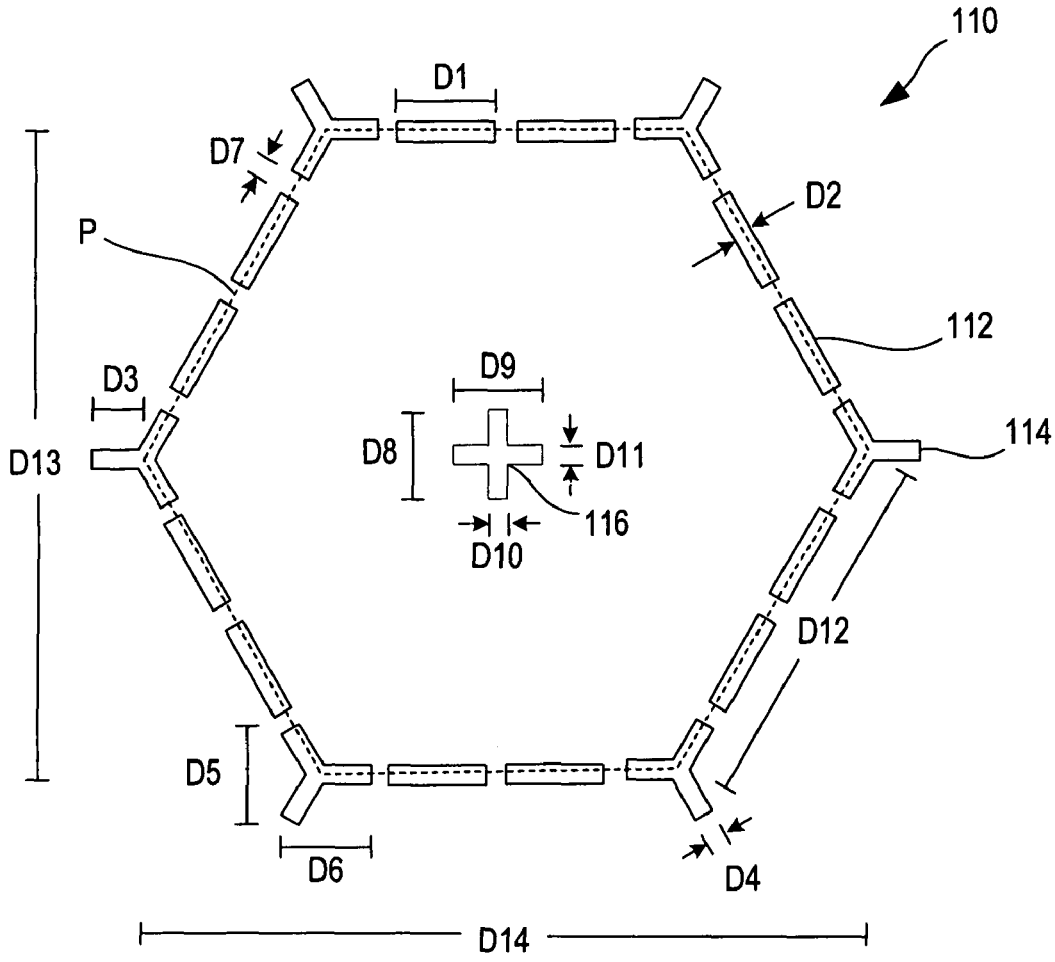
FIG. 1C schematically depicts a segmented loop according to various aspects of the invention.

As best seen in FIG. 1C, each hexagonal loop 110 is formed from a plurality of microwave energy transparent side elements or segments ("side elements" or "side segments") 112 and microwave energy transparent corner elements or segments ("corner elements" or "corner segments") 114. More particularly, each hexagonal loop 110 is formed from 6 pairs of side segments 112 (12 side segments total) and 6 corner segments 114, with the pairs of side segments 112 and corner segments 114 alternating along the loop 110. However, other configurations are contemplated by the invention. For example, the hexagonal loops may be formed from 6 side segments and 6 corner segments, 9 side segments and 6 corner segments, 12 side segments and 6 corner segments, or any other number and arrangement of elements. The combination of side segments 112, corner segments 114, and the microwave energy interactive areas therebetween defines a perimeter P (shown in dashed form) of each loop 110.

In this example, the side segments 112 are substantially rectangular in shape. Each side segment 112 has a first dimension D1 and a second dimension D2, for example, a length and a width. The corner segments 114 resemble a trio of overlapping substantially rectangular areas or segments, and are referred to herein as having a "tri-star" shape. However, other shapes are contemplated hereby. Each of the three "arms" that form the corner segments 114 has a first dimension D3 and a second dimension D4, for example, a length and a width. The overall tri-star shape also has a first dimension D5 and a second dimension D6, for example, a length and a width. Each of the segments 112 and 114 is separated from an adjacent segment 112 or 114 a distance D7.

Additionally, the structure 100 includes a plurality of independent or "floating" microwave energy transparent elements or "islands" 116, each of which is disposed within one of the segmented loops 110 (except those that islands that lie proximate an edge of the structure, which may be within or bordered by only a partial loop). In this example, the microwave energy transparent elements 116 are substantially cross-shaped. However, it will be understood that the element may be a circle, triangle, square, pentagon, hexagon, star, or any other regular or irregular shape.

The substantially cross-shaped element 116 may be considered to comprise two orthogonally arranged rectangular segments that overlap at their respective midpoints, or may be viewed as four rectangular "arms" overlapping at one end of each thereof. The overlapping rectangular segments or arms may have substantially the same dimensions or may differ from one another. In any case, each element 116 has a first overall dimension D8 and a second overall dimension D9, for example, a length and a width (either or both of which may correspond to the length of one of the rectangular segments), a third dimension D10, and a fourth dimension D11 corresponding to the respective width of each arm of the cross-shaped element 116. In this example, the microwave energy transparent element 116 is located substantially centrally within the hexagonal loop 110. However, other arrangements of loops and islands are contemplated hereby.

Each of the various loops also includes a side length D12, a side to side length ("minor length") D13, a diametrically opposed, corner to corner length ("major length") D14, and numerous other specifications that may be used to characterize the various susceptor structures of the invention.

In one aspect, the arrangement of microwave energy inactive areas may distribute power over the structure, thereby enhancing the heating, browning, and/or crisping of an adjacent food item. More particularly, the array of interconnected segmented loops, for example, loops 110 may be dimensioned to induce resonance of microwave energy along each loop and across the array of loops, and therefore may be referred to as "resonant loops". As a result, the flow of current around each loop increases while the percentage of reflected microwave energy decreases. This, in turn, provides more uniform heating, browning, and/or crisping of the food item. Further, the enhanced power distribution across the structure also reduces the potential for overheating, crazing, or charring of the structure in any particular area.

To create the resonant effect, the peripheral length of the segmented loop (including both microwave energy transparent and microwave energy interactive areas as shown in FIG. 1C), in this example, hexagonal loop 110, is generally selected to be about one-half of the effective wavelength in an operating microwave oven. For example, it has been observed that the effective wavelength in a microwave oven is about 12.0 cm where a susceptor is used (as compared with the theoretical wavelength of 12.24 cm). In such an example, the peripheral length of each hexagonal loop may be selected to be about 6 cm (60 mm). However, other peripheral lengths are contemplated hereby.

Figure 1D:
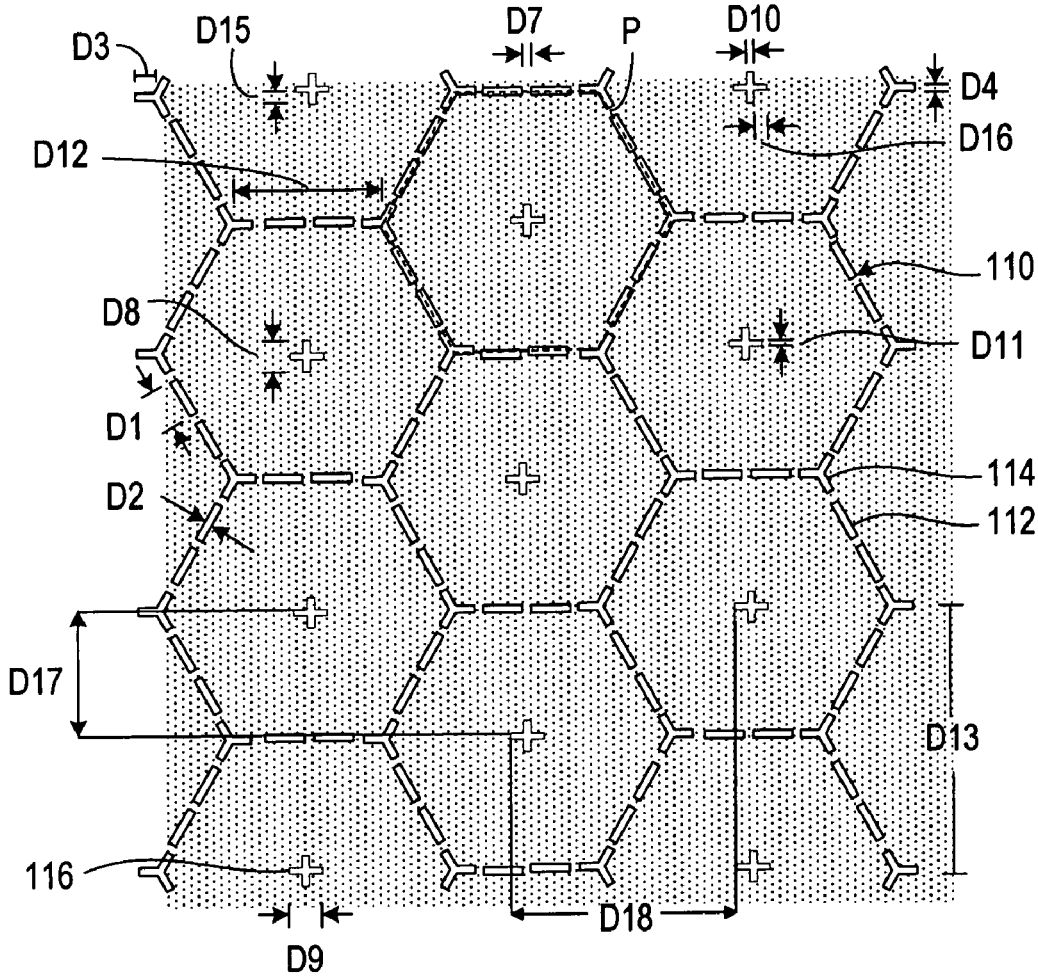
FIG. 1D schematically depicts an enlarged view of the arrangement of microwave energy interactive and transparent elements of FIG. 1A, according to various aspects of the invention.

Numerous exemplary values for the various dimensions or specifications for an exemplary arrangement of elements is provided with reference to FIG. 1D, in which a pattern of resonant hexagonal "fuse" loops 110 is provided in a susceptor structure, for example, susceptor structure 100 (FIG. 1A), with the microwave energy interactive material 102 being shown schematically by stippling. For example, each side segment 112 may have a first dimension, for example, a length D1, of about 2 mm and a second dimension, for example, a width D2, of about 0.5 mm. Each "arm" of the tri-star corner segment 114 may have a length D3 of about 1.5 mm and a width D4 of about 0.5 mm. The spacing D7 between each side segment 112 and between each rectangular segment 112 and corner segment 114 may be about 1 mm. The overall perimeter P of each segmented or broken hexagonal loop 110 may be about 60 mm. Each rectangular segment that forms the cross may have a respective length D8 or D9 of about 2 mm and a respective width D10 or D11 of about 0.5 mm. The cross-shaped element 116 may have an overall first dimension D8 of about 2 mm and an overall second dimension D9 of about 2 mm. The side length D12 may be about 10 mm and the side to side length ("minor length") D13 may be about 17.8 mm. Dimension D15 may be about 0.75 mm, D16 may be about 0.75 mm, D17 may be about 8.9 mm, and D18 may be about 15.4 mm.

It will be understood that the various dimensions that define a particular susceptor structure may vary for each application. As such, numerous other dimensions and ranges of dimensions are contemplated hereby.

Thus, in each of various examples, dimensions D1, D2, D3, D4, D5, D6, D7, D8, D9, D10, and D11 may have any suitable value or may fall within a range of suitable values. More particularly, the side segments 112, corner segments 114, and microwave energy transparent islands or elements each may independently have respective dimensions D1, D2, D3, D4, D5, D6, D7, D8, D9, D10, D11, D15, and/or D16 of from about 0.1 to about 5 mm, from about 0.2 to about 3 mm, from 0.25 to about 0.75 mm, from about 0.3 to about 2.6 mm, from about 0.4 to about 2.5 mm, from about 0.4 to about 0.6, from about 0.5 to 2 mm, from about 0.8 to about 2.2 mm, or from about 1.75 to about 2.25 mm.

Still more particularly, in each of various examples, the various dimensions D1, D2, D3, D4, D5, D6, D7, D8, D9, D10, D11, D15, and/or D16 each independently may be about 0.1 mm, about 0.15 mm, about 0.2 mm, about 0.25 mm, about 0.3 mm, about 0.35 mm, about 0.4 mm, about 0.45 mm, about 0.5 mm, about 0.55 mm, about 0.6 mm, about 0.65 mm, about 0.7 mm, about 0.75 mm, about 0.8 mm, about 0.85 mm, about 0.9 mm, about 0.95 mm, about 1 mm, about 1.05 mm, about 1.1 mm, about 1.15 mm, about 1.2 mm, about 1.25 mm, about 1.3 mm, about 1.35 mm, about 1.4 mm, about 1.45 mm, about 1.5 mm, about 1.55 mm, about 1.6 mm, about 1.65 mm, about 1.7 mm, about 1.75 mm, about 1.8 mm, about 1.85 mm, about 1.9 mm, about 1.95 mm, about 2 mm, about 2.05 mm, about 2.1 mm, about 2.15 mm, about 2.2 mm, about 2.25 mm, about 2.3 mm, about 2.35 mm, about 2.4 mm, about 2.45 mm, about 2.5 mm, about 2.55 mm, about 2.6 mm, about 2.65 mm, about 2.7 mm, about 2.75 mm, about 2.8 mm, about 2.85 mm, about 2.9 mm, about 2.95 mm, or about 3 mm. Other values and ranges of values are contemplated hereby.

Likewise, in each of various examples, dimensions D12, D13, D14, D17, and D18 may have any suitable value or may fall within a range of suitable values. More particularly, in each of various examples, D12, D13, D14, D17, and/or D18 each independently may be from about 5 to about 25 mm, from about 10 to about 20 mm, from about 12 to about 15 mm, from about 5 to about 10 mm, from about 10 to about 15 mm, from about 15 to about 20 mm, or from about 20 to about 25 mm.

Still more particularly, in each of various examples, the various dimensions D12, D13, D17, and/or D18 each independently may be about 5 mm, about 5.5 mm, about 6 mm, about 6.5 mm, about 7 mm, about 7.5 mm, about 8 mm, about 8.5 mm, about 9 mm, about 9.5 mm, about 10 mm, about 10.5 mm, about 11 mm, about 11.5 mm, about 12 mm, about 12.5 mm, about 13 mm, about 13.5 mm, about 14 mm, about 14.5 mm, about 15 mm, about 15.5 mm, about 16 mm, about 16.5 mm, about 17 mm, about 17.5 mm, about 18 mm, about 18.5 mm, about 19 mm, about 19.5 mm, about 20 mm, about 20.5 mm, about 21 mm, about 21.5 mm, about 22 mm, about 22.5 mm, about 23 mm, about 23.5 mm, about 24 mm, about 24.5 mm, or about 25 mm.

In another aspect, the arrangement of microwave energy inactive or transparent areas 108 may control the propagation of any cracks or crazing caused by localized overheating within the structure 100. The microwave energy inactive loops 110 and crosses 116 positioned at various respective angles to one another work in concert as a "multidirectional fuse" to manage, control, and terminate the propagation of current, and therefore crazing, between the inactive areas. The multidirectional arrangement of inactive areas therefore provides controlled, directional voltage breakage or interruption, rather than random voltage breakage or interruption, thereby resulting in better protection of the structure. In a structure without the hexagonal loops, such as that shown in U.S. Pat. Nos. 5,412,187 and 5,530,231, the crosses can provide only limited, bidirectional protection against crazing of the susceptor.

The arrangement of microwave energy interactive and microwave energy transparent areas can be selected to provide various levels of heating, as needed or desired for a particular application. For example, where greater heating is desired, the substantially rectangular inactive areas could be made to be wider. In doing so, more microwave energy is transmitted to the food item. Alternatively, by narrowing the substantially rectangular areas, more microwave energy is absorbed, converted into thermal energy, and transmitted to the surface of the food item to enhance browning and/or crisping. Numerous other arrangements and configurations are contemplated hereby.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymer or other suitable matrix or binder, and may include flakes of an electroconductive metal, for example, aluminum.

The substrate typically comprises an electrical insulator, for example, a polymer film or other polymeric material. As used herein the terms "polymer", "polymer film", and "polymeric material" include, but are not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.). In one particular example, the polymer film comprises polyethylene terephthalate having a thickness of about 48 gauge. In another particular example, the polymer film comprises heat sealable polyethylene terephthalate having a thickness of about 48 gauge.

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a water vapor transmission rate as measured using ASTM F1249 of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5,221,419; 5,213,902; 5,117,078; 5,039,364; 4,963,420; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the invention.

Returning to FIGS. 1A and 1B, the susceptor film 106 may be joined at least partially to a dimensionally stable support 118 using a continuous or discontinuous layer adhesive or other suitable material 120 (shown as continuous in FIG. 1B). If desired, all or a portion of the support may be formed at least partially from a paperboard material having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

Where a more flexible construct is to be formed, the support 118 may comprise a paper or paper-based material generally having a basis weight of from about 15 to about 60 lbs/ream, for example, from about 20 to about 40 lbs/ream. In one particular example, the paper has a basis weight of about 25 lbs/ream.

As stated above, the susceptor 106 may be joined to the support 118 in any manner and using any suitable material, for example, a binding layer or adhesive 120. In one example, the layers are joined using a layer of a polyolefin, for example, polypropylene, polyethylene, low density polyethylene, or any other polymer or combination of polymers. However, other adhesives are contemplated hereby. The adhesive may have a basis weight or dry coat weight of from about 3 to about 18 lb/ream. In one example, the adhesive may have a dry coat weight of from about 5 to about 15 lb/ream. In another example, the adhesive may have a dry coat weight of from about 8 to about 12 lb/ream.

It will be understood that with some combinations of materials, the microwave interactive element, for example, element 102, may have a grey or silver color that is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

The present invention may be understood further by way of the following examples, which are not intended to be limiting in any manner.

Test Procedures

Low power RAT: Each sample evaluated for low power RAT was placed into an HP8753A Network Analyzer. The output is used to calculate the reflection (R), absorption (A), and transmission (T) (collectively "RAT") characteristics of the sample. A merit factor then can be calculated as follows:

$$\text{Merit factor (MF)}=A/(1-R).$$

A higher MF generally means that the susceptor will convert more microwave energy to sensible heat when competing with the food product for available microwave energy.

High Power RAT: Each sample evaluated for high power RAT was subjected to an increasing E-field strength using a Magnetron microwave power generator. The input power, reflected power, and transmitted power were measured and the RAT values were reported.

Open Load Abuse: Each sample evaluated for open load abuse characteristics was heated in a microwave oven at 100% power without a food load until equilibrium heating was reached or until a self-sustaining fire occurred. Various microwave ovens were used to conduct the open load abuse testing, as set forth in Table 1.

TABLE 1

| Microwave Oven | Description | Output (W) | Volume (cubic feet) |
|---|---|---|---|
| 1 | Panasonic Commercial Model NE-1757CR | 1600 | 0.6 |
| 2 | Panasonic Inverter Model No. NN-S740WA | 1200 | 1.2 |
| 3 | Orbit/LG Model No. LTS1240TB | 1100 | 1.2 |
| 4 | Emerson Model No. MW9170BC | 1000 | 1.1 |

Image Analysis: Each susceptor structure evaluated was cut into a sample having a size of about 2 in.×4 in. and mounted in a cardboard frame. One at a time, the samples were placed on the auto macro-stage of a Leica QWIN Image Analysis System. The samples were illuminated by four flood lamps that provided incident omni-directional darkfield illumination.

The cracks on the susceptor structures were examined with a macro lens, and Leica DFC 350 camera, sufficient to image a 1 cm wide field-of-view (FOV). Twenty-eight (28) 1 cm fields were scanned using auto-stage motion in a non-adjacent 4×7 matrix, with a stop at each field position for focus, lighting, and threshold adjustments needed to compensate for sample buckling, illumination variability, and background scorching.

The cracks were detected in auto-delineation mode using various steps of binary "open" and "close" operations, combined with image subtraction, to remove noise and the intentionally imparted microwave energy transparent areas (e.g., segmented hexagonal loops and crosses). The image processing and procedures listed above are known to those proficient in the art of image analysis.

Parameters measured were percent area (% A) covered by cracks of all types, shown as a histogram with statistics, standard deviation (SD), crack length (L) presented as a histogram with statistics, and mean crack width (W). The crack length was terminated by the image frame boundary to avoid the need for "tiling" (adjacent filed continuation of elongated features). A randomly acquired FOV image, the last field examined (field no. 28), was taken for each sample (photos not included). No section of a "typical" image was attempted. Additionally, the total crack length within the total area scanned (L/A) was calculated in mm/sq. cm.

EXAMPLES

Numerous samples of microwave energy interactive structures were prepared and evaluated according to the procedures described above, as set forth below.

Example 1

An exemplary susceptor film according to the invention having an optical density of about 0.26 was laminated to paper having a basis weight of about 35 lb/ream. The susceptor film was substantially similar to the structure shown schematically in FIG. 1D, except for variations that will be understood by those in the art. In this example, D1 was about 2 mm, D2 was about 0.5 mm, D2 was about 1.5 mm, D4 was about 0.5 mm, D7 was about 1 mm, D8 was about 2 mm, D9 was about 2 mm, D10 was about 0.5 mm, D11 was about 0.5 mm, D12 was about 10 mm, D13 was about 17.8, D15 was about 0.75 mm, D16 was about 0.75 mm, D17 was about 8.9 mm, and D18 was about 15.4 mm. Six samples were prepared and evaluated for low power RAT. Each sample was tested in the machine direction and the cross machine direction. The results are presented in Table 2.

TABLE 2

| Samples 1-6 | R (%) | A (%) | T (%) | MF (%) |
|---|---|---|---|---|
| Average (%) | 47.3 | 42.4 | 10.3 | 80.6 |
| Standard deviation (%) | 3.6 | 2.4 | 2.1 | 3.1 |
| Maximum (%) | 51 | 84 | 48 | 84 |
| Minimum (%) | 40 | 39 | 8 | 76 |

Samples 1-6 also were subjected to open load testing in a microwave oven. Each sample sustained heating for a period of greater than 120 seconds without creating a fire.

Figure 1E:
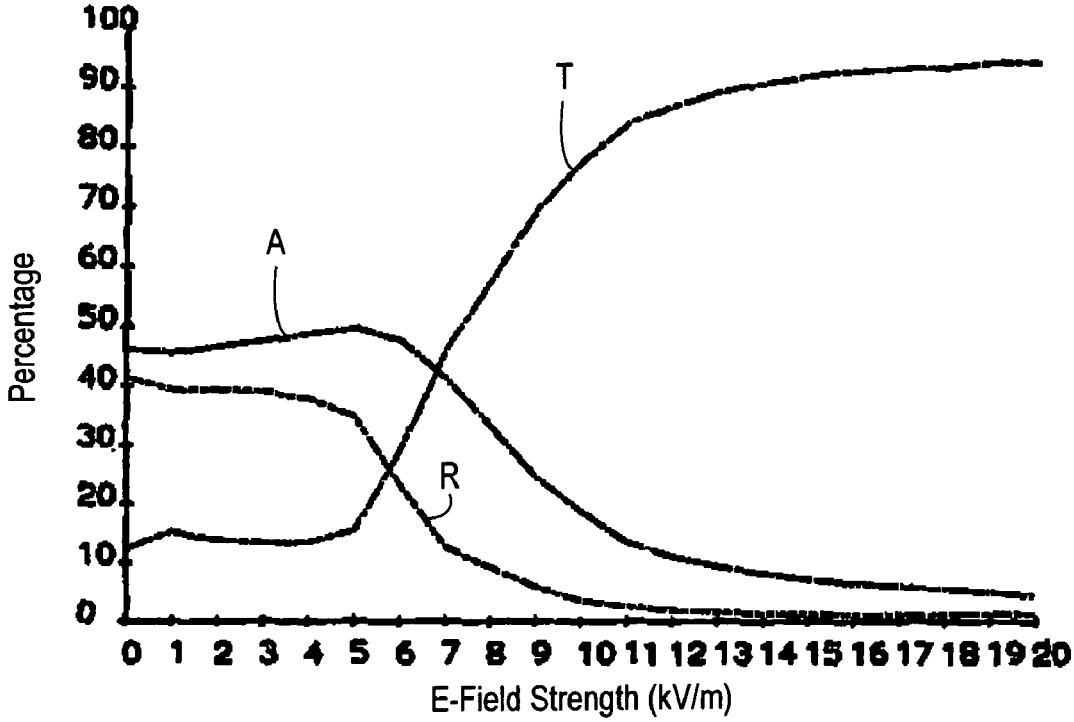
FIGS. 1E-1H present the reflection-absorption-transmission characteristics of the arrangement of FIG. 1D under open load, high power conditions.
Figure 1F:
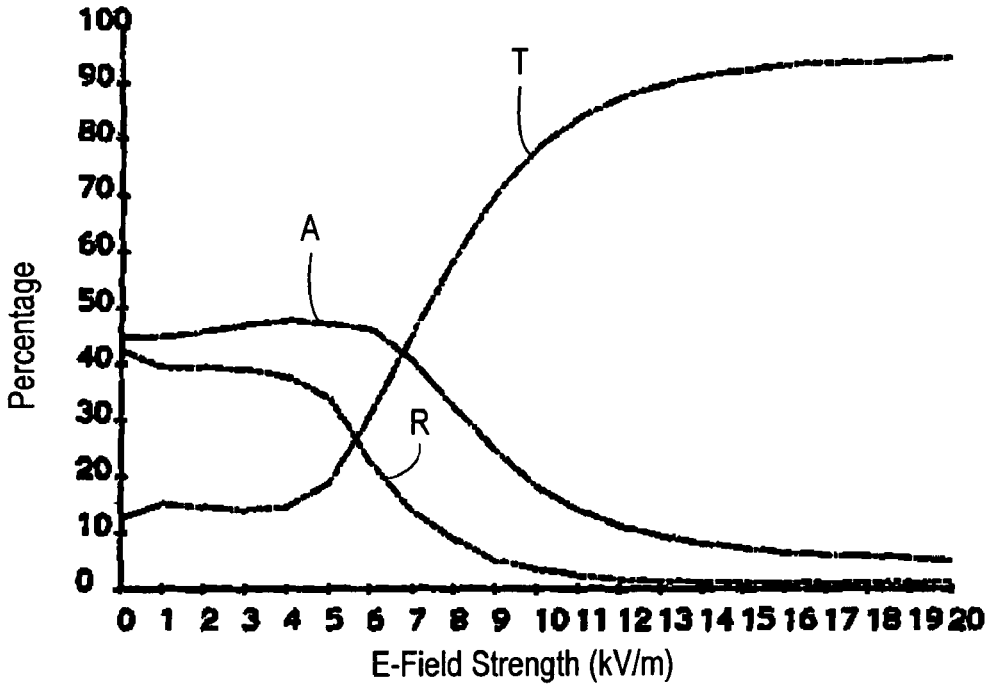
Figure 1G:
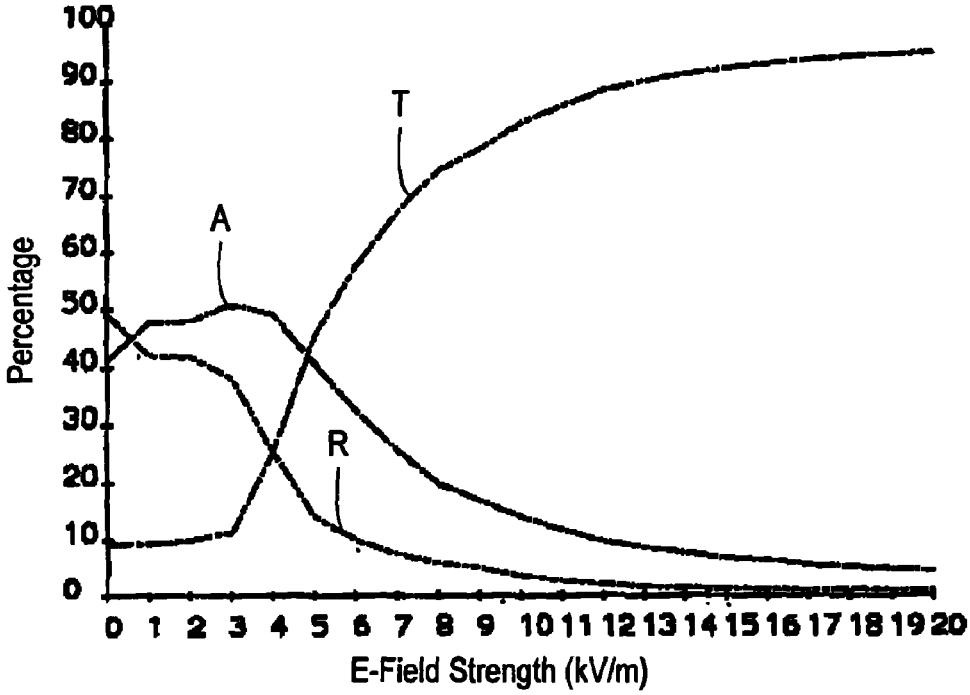
Figure 1H:
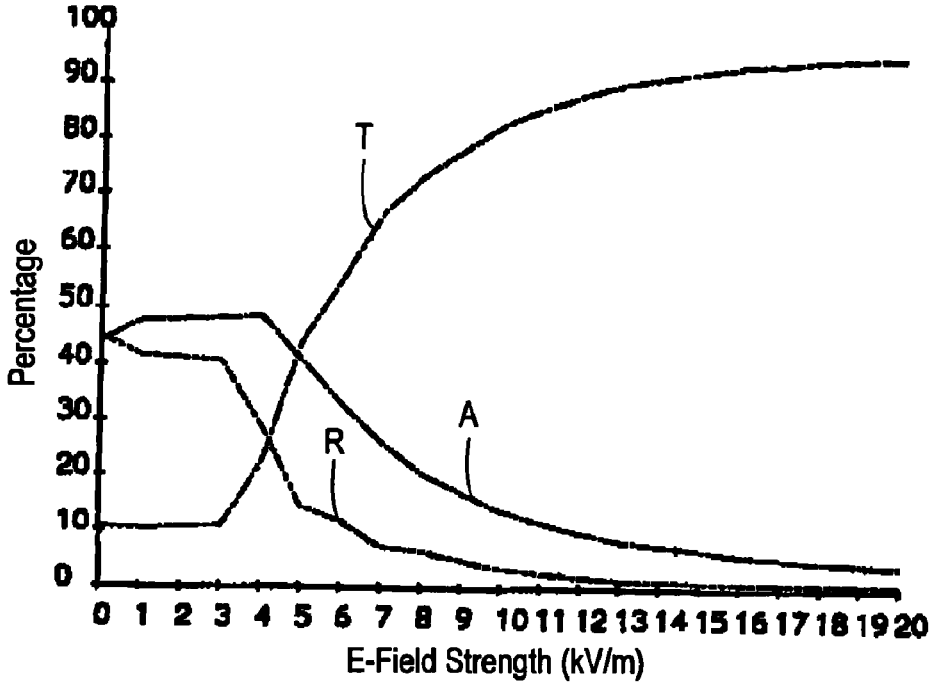

The structure also was evaluated for high power RAT. The results are presented in Table 3 and FIG. 1E (Sample 7, oriented in the machine direction), Table 4 and FIG. 1F (Sample 8, oriented in the cross machine direction), Table 5 and FIG. 1G (Sample 9, oriented in the machine direction), and Table 6 and FIG. 1H (Sample 10, oriented in the cross machine direction).

TABLE 3

| Sample | E-field strength (kV/m) | Incident energy | % Reflected | % Absorbed | % Transmitted |
|---|---|---|---|---|---|
| 7 | 0 | — | 41.5 | 46.1 | 12.4 |
| | 1 | 24.2 | 39.3 | 45.5 | 15.3 |
| | 2 | 36.8 | 39.4 | 46.7 | 13.9 |
| | 3 | 53.1 | 39.0 | 47.5 | 13.4 |
| | 4 | 82.8 | 37.7 | 48.8 | 13.5 |
| | 5 | 121.1 | 34.8 | 49.6 | 15.5 |
| | 6 | 155.2 | 23.1 | 47.7 | 29.2 |
| | 7 | 201.4 | 12.7 | 41.1 | 46.2 |
| | 8 | 257.6 | 9.3 | 33.1 | 57.7 |
| | 9 | 319.9 | 5.9 | 24.4 | 69.6 |
| | 10 | 386.4 | 3.7 | 18.7 | 77.6 |
| | 11 | 462.4 | 2.6 | 13.5 | 84.0 |
| | 12 | 548.3 | 1.9 | 11.2 | 86.9 |
| | 13 | 639.7 | 1.5 | 9.4 | 89.1 |
| | 14 | 739.6 | 1.2 | 8.2 | 90.6 |
| | 15 | 847.2 | 1.1 | 7.1 | 91.8 |
| | 16 | 966.1 | 1.0 | 6.5 | 92.5 |
| | 17 | 1086.4 | 1.0 | 5.9 | 93.1 |
| | 18 | 1219.0 | 1.1 | 5.6 | 93.3 |
| | 19 | 1358.3 | 1.2 | 4.9 | 94.0 |
| | 20 | 1506.6 | 1.3 | 4.5 | 94.2 |

TABLE 4

| Sample | E-field strength (kV/m) | Incident energy | % Reflected | % Absorbed | % Transmitted |
|---|---|---|---|---|---|
| 8 | 0 | — | 42.5 | 45.0 | 12.5 |
| | 1 | 24.3 | 39.5 | 44.9 | 15.2 |
| | 2 | 36.2 | 39.5 | 45.9 | 14.6 |
| | 3 | 52.2 | 39.1 | 47.1 | 14.0 |
| | 4 | 80.4 | 37.7 | 47.8 | 14.6 |
| | 5 | 115.9 | 33.9 | 47.2 | 18.9 |
| | 6 | 152.8 | 22.5 | 46.3 | 31.1 |
| | 7 | 199.1 | 13.8 | 40.6 | 45.6 |
| | 8 | 253.5 | 9.0 | 32.4 | 58.6 |
| | 9 | 314.8 | 5.1 | 24.7 | 70.1 |
| | 10 | 379.3 | 3.6 | 18.2 | 78.2 |
| | 11 | 456.0 | 2.4 | 14.1 | 83.6 |
| | 12 | 539.5 | 1.7 | 11.2 | 87.1 |
| | 13 | 629.5 | 1.3 | 9.4 | 89.3 |
| | 14 | 727.8 | 1.1 | 9.0 | 91.0 |
| | 15 | 833.7 | 1.0 | 7.2 | 91.8 |
| | 16 | 948.4 | 0.9 | 6.4 | 92.7 |
| | 17 | 1069.1 | 1.0 | 5.9 | 93.1 |
| | 18 | 1202.3 | 1.0 | 5.8 | 93.1 |
| | 19 | 1339.7 | 1.1 | 5.4 | 93.5 |
| | 20 | 1482.5 | 1.2 | 4.9 | 94.0 |

TABLE 5

| Sample | E-field strength (kV/m) | Incident energy | % Reflected | % Absorbed | % Transmitted |
|---|---|---|---|---|---|
| 9 | 0 | — | 49.4 | 41.2 | 9.4 |
| | 1 | 24.0 | 42.1 | 47.9 | 9.6 |
| | 2 | 36.6 | 41.8 | 48.1 | 10.1 |
| | 3 | 51.4 | 38.1 | 50.8 | 11.3 |
| | 4 | 76.6 | 25.3 | 49.1 | 25.6 |
| | 5 | 105.0 | 14.1 | 40.4 | 45.5 |
| | 6 | 142.9 | 10.1 | 32.3 | 57.5 |
| | 7 | 190.1 | 7.5 | 25.6 | 67.0 |
| | 8 | 244.9 | 6.0 | 19.8 | 74.2 |
| | 9 | 306.9 | 5.1 | 17.0 | 78.0 |
| | 10 | 371.5 | 3.6 | 14.0 | 82.4 |
| | 11 | 4447.7 | 2.7 | 11.7 | 85.5 |
| | 12 | 529.7 | 2.1 | 9.8 | 88.1 |
| | 13 | 619.4 | 1.6 | 8.6 | 89.7 |
| | 14 | 716.1 | 1.4 | 7.6 | 91.0 |
| | 15 | 820.4 | 1.2 | 6.8 | 92.0 |
| | 16 | 935.4 | 1.1 | 6.3 | 92.7 |
| | 17 | 1052.0 | 1.0 | 5.5 | 93.5 |
| | 18 | 1180.3 | 0.9 | 5.1 | 94.0 |
| | 19 | 1315.2 | 0.9 | 4.7 | 94.4 |
| | 20 | 1458.8 | 0.9 | 4.5 | 94.6 |

TABLE 6

| Sample | E-field strength (kV/m) | Incident energy | % Reflected | % Absorbed | % Transmitted |
|---|---|---|---|---|---|
| 10 | 0 | — | 45.1 | 44.2 | 10.7 |
| | 1 | 24.9 | 41.8 | 47.8 | 10.4 |
| | 2 | 37.3 | 41.3 | 48.0 | 10.7 |
| | 3 | 53.2 | 40.8 | 48.3 | 10.9 |
| | 4 | 79.6 | 29.0 | 48.7 | 22.2 |
| | 5 | 107.4 | 14.6 | 41.0 | 44.3 |
| | 6 | 145.9 | 12.0 | 33.0 | 55.0 |
| | 7 | 193.6 | 7.2 | 26.1 | 66.7 |
| | 8 | 249.5 | 6.5 | 20.4 | 73.1 |
| | 9 | 311.9 | 4.9 | 17.2 | 78.0 |
| | 10 | 377.6 | 3.5 | 13.9 | 82.6 |
| | 11 | 453.9 | 2.7 | 11.8 | 85.5 |
| | 12 | 537.0 | 2.1 | 10.0 | 87.9 |
| | 13 | 626.6 | 1.6 | 8.5 | 89.9 |
| | 14 | 724.4 | 1.4 | 7.6 | 91.0 |

TABLE 6-continued

| Sample | E-field strength (kV/m) | Incident energy | % Reflected | % Absorbed | % Transmitted |
|---|---|---|---|---|---|
| | 15 | 829.9 | 1.2 | 6.8 | 92.0 |
| | 16 | 944.1 | 1.0 | 5.9 | 93.1 |
| | 17 | 1064.1 | 1.0 | 5.5 | 93.5 |
| | 18 | 1194.0 | 1.0 | 4.8 | 94.2 |
| | 19 | 1330.5 | 0.9 | 4.5 | 94.6 |
| | 20 | 1475.7 | 0.9 | 4.3 | 94.8 |

Example 2

A plain susceptor film having an optical density of about 0.26 was laminated to paper having a basis weight of about 35 lb/ream. Twelve samples were prepared and evaluated to determine the low power RAT characteristics. Each sample was tested in the machine direction and the cross machine direction. The results are presented in Table 7.

TABLE 7

| Samples 11-22 | R (%) | A (%) | T (%) | MF (%) |
|---|---|---|---|---|
| Average (%) | 49 | 42.3 | 8.4 | 83.5 |
| Standard deviation (%) | 1.5 | 1.0 | 0.6 | 0.7 |
| Maximum (%) | 53 | 44 | 9 | 85 |
| Minimum (%) | 46 | 40 | 7 | 83 |

Figure 2A:
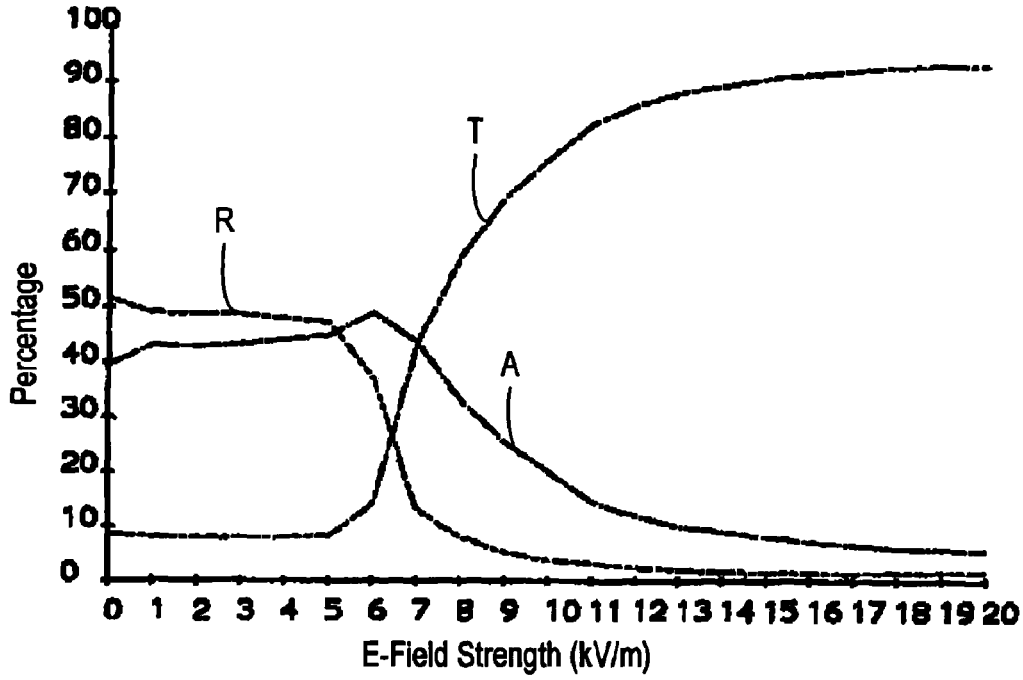
FIGS. 2A and 2B present the reflection-absorption-transmission characteristics of a plain susceptor film joined to paper under open load, high power conditions, for comparative purposes.
Figure 2B:
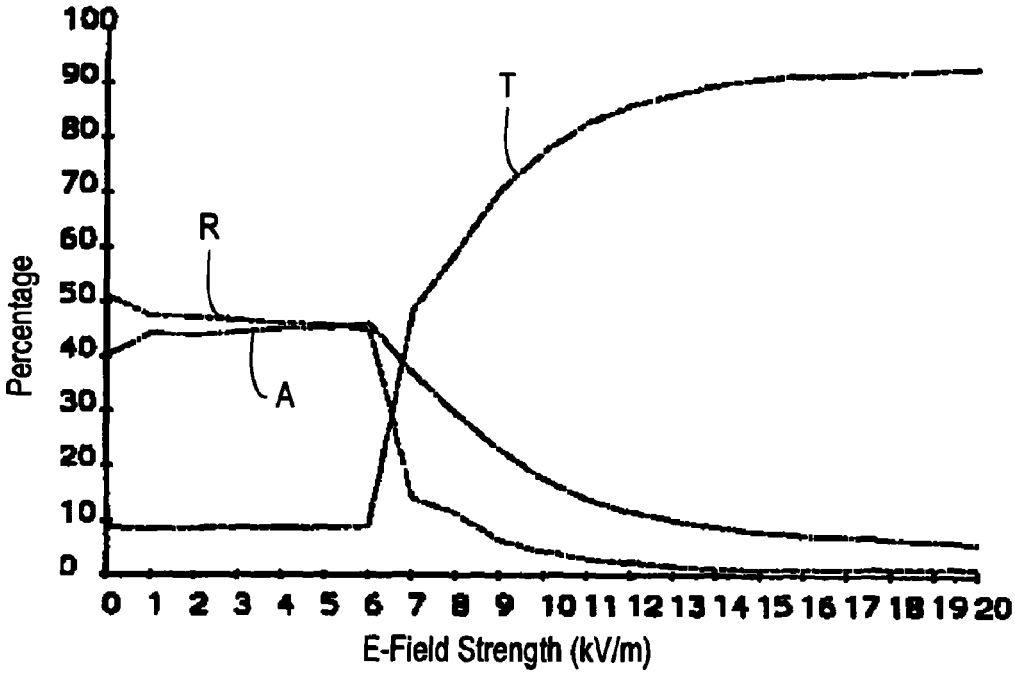

The structure also was evaluated to determine high power RAT characteristics. The results are presented in Table 8 and FIG. 2A (Sample 23, oriented in the machine direction) and Table 9 and FIG. 2B (Sample 24, oriented in the cross machine direction).

TABLE 8

| Sample | E-field strength (kV/m) | Incident energy | % Reflected | % Absorbed | % Transmitted |
|---|---|---|---|---|---|
| 23 | 0 | — | 51.8 | 39.6 | 8.6 |
| | 1 | 26.4 | 48.9 | 43.2 | 8.0 |
| | 2 | 39.1 | 48.8 | 43.0 | 7.9 |
| | 3 | 55.7 | 48.7 | 43.4 | 7.9 |
| | 4 | 86.3 | 48.0 | 44.1 | 7.9 |
| | 5 | 130.0 | 47.1 | 44.8 | 8.1 |
| | 6 | 173.8 | 37.1 | 48.9 | 14.0 |
| | 7 | 203.2 | 13.2 | 43.7 | 43.2 |
| | 8 | 258.8 | 8.1 | 33.0 | 58.9 |
| | 9 | 321.4 | 5.3 | 25.5 | 69.2 |
| | 10 | 387.3 | 3.8 | 20.0 | 76.2 |
| | 11 | 464.5 | 3.1 | 14.5 | 82.4 |
| | 12 | 549.5 | 2.4 | 11.9 | 85.7 |
| | 13 | 641.2 | 2.0 | 10.1 | 87.9 |
| | 14 | 739.6 | 1.7 | 9.0 | 89.3 |
| | 15 | 847.2 | 1.5 | 8.0 | 90.6 |
| | 16 | 963.8 | 1.4 | 7.2 | 91.4 |
| | 17 | 1083.9 | 1.3 | 6.6 | 92.0 |
| | 18 | 1216.2 | 1.4 | 6.0 | 92.7 |
| | 19 | 1355.2 | 1.4 | 5.7 | 92.9 |
| | 20 | 1503.1 | 1.5 | 5.6 | 92.9 |

TABLE 9

| Sample | E-field strength (kV/m) | Incident energy | % Reflected | % Absorbed | % Transmitted |
|---|---|---|---|---|---|
| 24 | 0 | — | 51.3 | 40.0 | 8.7 |
| | 1 | 24.2 | 47.5 | 44.2 | 8.3 |
| | 2 | 37.1 | 47.4 | 43.9 | 8.6 |

TABLE 9-continued

| Sample | E-field strength (kV/m) | Incident energy | % Reflected | % Absorbed | % Transmitted |
|---|---|---|---|---|---|
| | 3 | 52.8 | 46.8 | 44.5 | 8.7 |
| | 4 | 81.8 | 46.2 | 45.2 | 8.7 |
| | 5 | 122.7 | 46.0 | 45.3 | 8.7 |
| | 6 | 176.2 | 45.0 | 46.1 | 8.9 |
| | 7 | 196.8 | 14.3 | 36.9 | 48.7 |
| | 8 | 252.3 | 11.5 | 29.4 | 59.2 |
| | 9 | 313.3 | 6.5 | 23.1 | 70.5 |
| | 10 | 379.3 | 4.5 | 17.8 | 77.6 |
| | 11 | 455.0 | 3.1 | 14.1 | 82.8 |
| | 12 | 538.3 | 2.4 | 11.7 | 85.9 |
| | 13 | 628.1 | 1.8 | 10.3 | 87.9 |
| | 14 | 726.1 | 1.3 | 8.9 | 89.7 |
| | 15 | 831.8 | 1.2 | 8.0 | 90.8 |
| | 16 | 948.4 | 1.2 | 7.4 | 91.4 |
| | 17 | 1069.1 | 1.2 | 7.2 | 91.6 |
| | 18 | 1199.5 | 1.3 | 6.7 | 92.0 |
| | 19 | 1336.6 | 1.3 | 6.4 | 92.3 |
| | 20 | 1485.9 | 1.4 | 5.9 | 92.7 |

Example 3

Figure 3A:
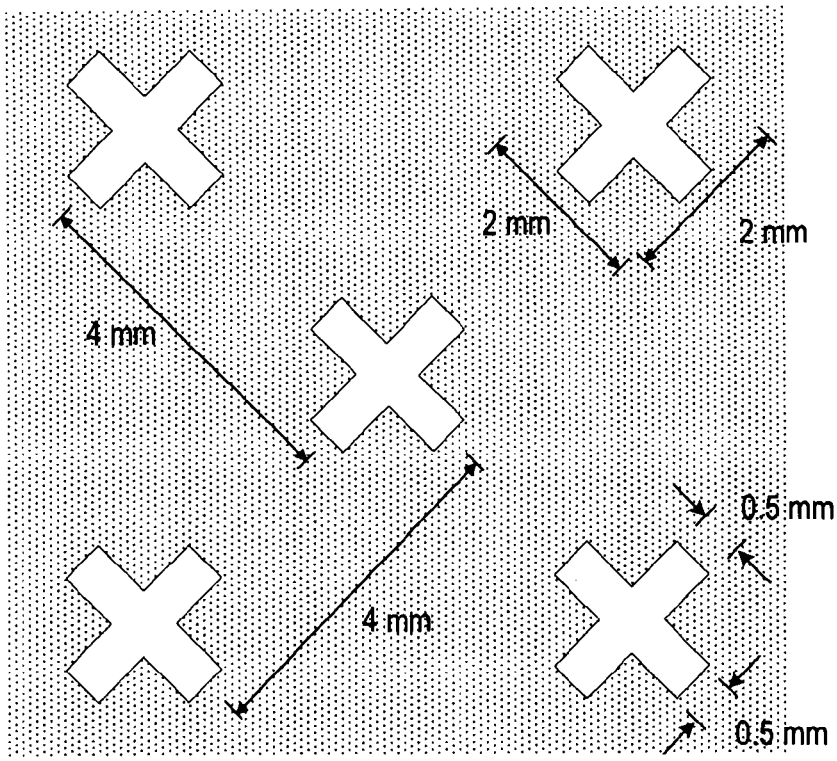
FIG. 3A schematically depicts another exemplary arrangement of microwave energy interactive and transparent elements, with approximate dimensions.

A susceptor film with a simple cross pattern, substantially as shown schematically in FIG. 3A (available commercially from Graphic Packaging International, Inc. (Marietta, Ga.)), was laminated to paper having a basis weight of about 35 lb/ream. Twenty-four samples were prepared and evaluated to determine the low power RAT characteristics of the structure. Each sample was tested in the machine direction and the cross-machine direction. The results are presented in Table 10.

TABLE 10

| Samples 25-48 | R (%) | A (%) | T (%) | MF (%) |
|---|---|---|---|---|
| Average (%) | 44.9 | 45.1 | 9.7 | 82.4 |
| Standard deviation (%) | 3.1 | 2.6 | 2.1 | 3.2 |
| Maximum (%) | 39 | 41 | 7 | 75 |
| Minimum (%) | 51 | 51 | 15 | 87 |

Figure 3B:
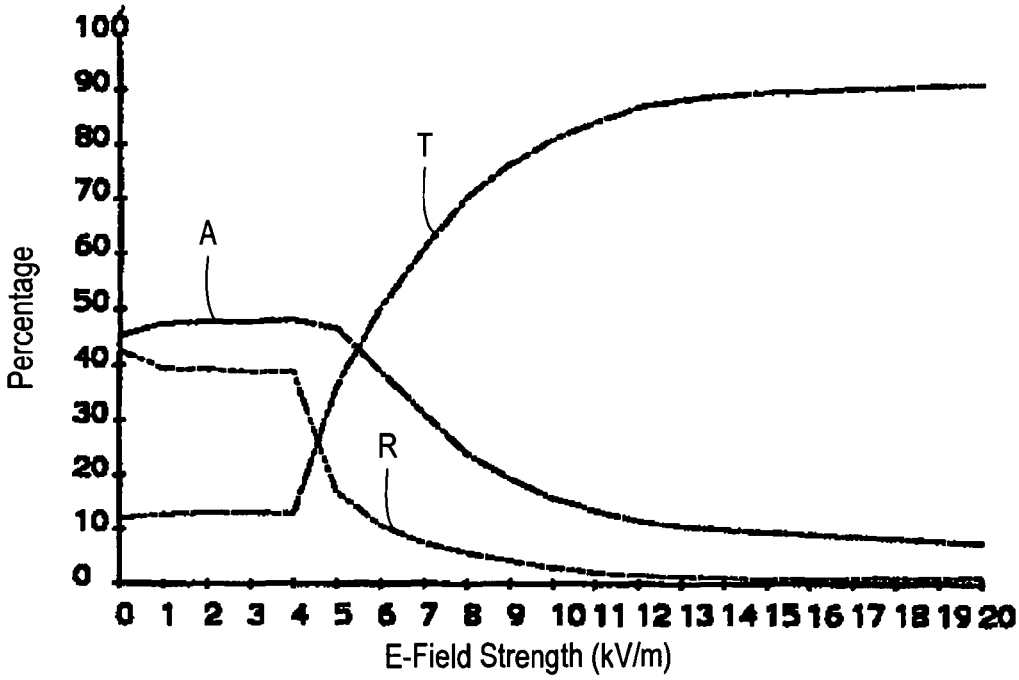
FIGS. 3B-3D present the reflection-absorption-transmission characteristics of the arrangement of FIG. 3A under open load, high power conditions.
Figure 3C:
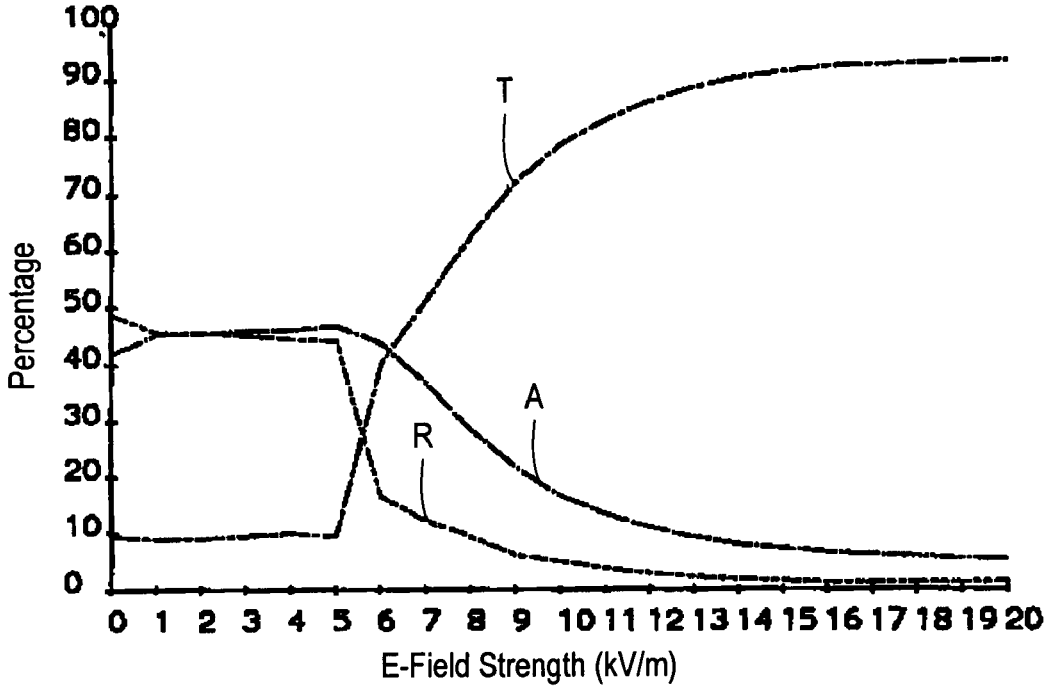
Figure 3D:
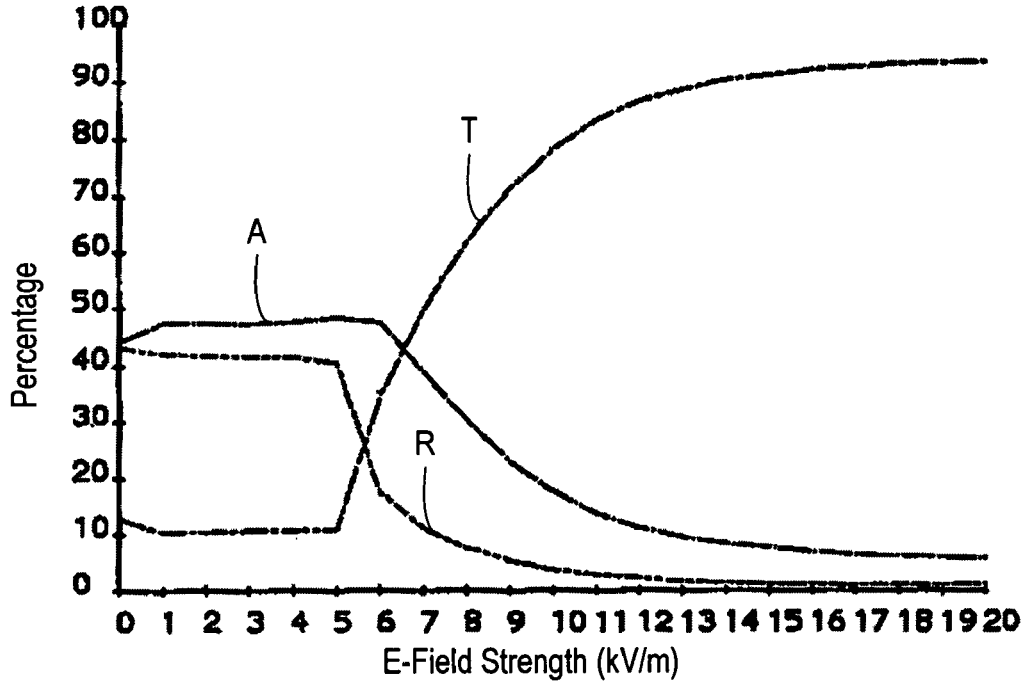

The structure also was subjected to high power RAT testing. The results are presented in Table 11 and FIG. 3B (Sample 49, oriented in the machine direction), Table 12 and FIG. 3C (Sample 50, oriented in the machine direction), and Table 13 and FIG. 3D (Sample 51, oriented in the cross machine direction).

TABLE 11

| Sample | E-field strength (kV/m) | Incident energy | % Reflected | % Absorbed | % Transmitted |
|---|---|---|---|---|---|
| 49 | 0 | — | 42.8 | 45.3 | 12.0 |
| | 1 | 25.5 | 39.6 | 47.5 | 12.9 |
| | 2 | 37.9 | 39.3 | 47.8 | 13.2 |
| | 3 | 54.5 | 38.9 | 47.9 | 13.2 |
| | 4 | 85.5 | 38.9 | 48.1 | 13.0 |
| | 5 | 112.2 | 17.0 | 46.6 | 36.3 |
| | 6 | 149.6 | 10.8 | 38.9 | 50.3 |
| | 7 | 199.5 | 7.5 | 31.4 | 61.1 |
| | 8 | 256.4 | 5.8 | 24.1 | 70.2 |
| | 9 | 319.9 | 4.4 | 19.4 | 76.2 |
| | 10 | 387.3 | 3.2 | 15.9 | 80.9 |
| | 11 | 464.5 | 2.4 | 13.5 | 84.1 |
| | 12 | 550.8 | 1.7 | 11.6 | 86.7 |
| | 13 | 642.7 | 1.4 | 10.5 | 88.1 |

TABLE 11-continued

| Sample | E-field strength (kV/m) | Incident energy | % Reflected | % Absorbed | % Transmitted |
|---|---|---|---|---|---|
| | 14 | 743.0 | 1.2 | 9.9 | 88.9 |
| | 15 | 851.1 | 1.1 | 9.4 | 89.5 |
| | 16 | 970.5 | 1.1 | 9.1 | 89.7 |
| | 17 | 1091.4 | 1.2 | 8.6 | 90.2 |
| | 18 | 1227.4 | 1.3 | 8.4 | 90.4 |
| | 19 | 1364.6 | 1.3 | 7.9 | 90.8 |
| | 20 | 1510.1 | 1.4 | 7.6 | 91.0 |

TABLE 12

| Sample | E-field strength (kV/m) | Incident energy | % Reflected | % Absorbed | % Transmitted |
|---|---|---|---|---|---|
| 50 | 0 | — | 48.8 | 41.8 | 9.4 |
| | 1 | 24.4 | 45.5 | 45.1 | 9.0 |
| | 2 | 37.2 | 45.4 | 45.2 | 9.1 |
| | 3 | 52.8 | 44.9 | 45.8 | 9.5 |
| | 4 | 82.2 | 44.3 | 45.9 | 9.9 |
| | 5 | 123.0 | 43.9 | 46.6 | 9.5 |
| | 6 | 147.9 | 16.4 | 43.5 | 40.1 |
| | 7 | 196.3 | 12.2 | 36.7 | 51.0 |
| | 8 | 251.2 | 9.4 | 28.3 | 62.4 |
| | 9 | 312.6 | 6.2 | 21.8 | 71.9 |
| | 10 | 378.4 | 5.0 | 16.6 | 78.4 |
| | 11 | 453.9 | 3.8 | 13.4 | 82.8 |
| | 12 | 537.0 | 2.9 | 11.0 | 86.1 |
| | 13 | 626.6 | 2.2 | 9.3 | 88.5 |
| | 14 | 724.4 | 1.8 | 8.0 | 90.2 |
| | 15 | 829.9 | 1.5 | 7.3 | 91.2 |
| | 16 | 946.2 | 1.3 | 6.6 | 92.5 |
| | 17 | 1064.1 | 1.3 | 6.3 | 92.1 |
| | 18 | 1196.7 | 1.3 | 6.0 | 92.7 |
| | 19 | 1130.5 | 1.3 | 5.5 | 93.1 |
| | 20 | 1475.7 | 1.4 | 5.3 | 93.3 |

TABLE 13

| Sample | E-field strength (kV/m) | Incident energy | % Reflected | % Absorbed | % Transmitted |
|---|---|---|---|---|---|
| 51 | 0 | — | 43.2 | 44.2 | 12.7 |
| | 1 | 24.0 | 42.1 | 47.5 | 10.4 |
| | 2 | 36.1 | 41.8 | 47.4 | 10.5 |
| | 3 | 51.3 | 41.7 | 47.4 | 10.7 |
| | 4 | 80.5 | 41.6 | 47.7 | 10.7 |
| | 5 | 119.7 | 40.6 | 48.5 | 10.9 |
| | 6 | 145.9 | 17.7 | 47.6 | 34.7 |
| | 7 | 191.4 | 11.2 | 39.0 | 49.8 |
| | 8 | 244.9 | 7.7 | 30.5 | 61.8 |
| | 9 | 304.8 | 5.5 | 23.2 | 71.3 |
| | 10 | 369.0 | 3.8 | 17.8 | 78.3 |
| | 11 | 442.6 | 3.0 | 13.8 | 83.2 |
| | 12 | 523.6 | 2.3 | 11.2 | 86.5 |
| | 13 | 612.4 | 1.7 | 9.7 | 88.5 |
| | 14 | 706.3 | 1.4 | 8.4 | 90.2 |
| | 15 | 811.0 | 1.2 | 7.8 | 91.0 |
| | 16 | 922.6 | 1.1 | 6.9 | 92.0 |
| | 17 | 1039.9 | 1.0 | 6.5 | 92.5 |
| | 18 | 1166.8 | 1.0 | 6.1 | 92.9 |
| | 19 | 1300.2 | 1.0 | 5.9 | 93.1 |
| | 20 | 1442.1 | 1.1 | 5.6 | 93.3 |

Example 4

Figure 4A:
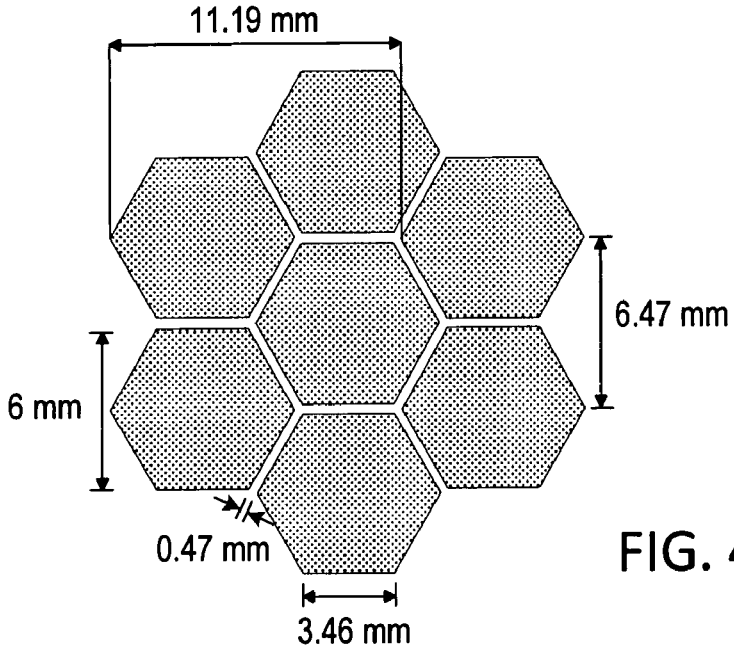
FIG. 4A schematically depicts still another exemplary arrangement of microwave energy interactive and transparent elements, with approximate dimensions.

A susceptor film including a plurality of solid hexagons of microwave energy interactive material, substantially as shown schematically in FIG. 4A, having an optical density of about 0.26, was laminated to paper having a basis weight of about 35 lb/ream. The resulting structure then was evaluated to determine low power RAT characteristics. Each of six samples was tested in the both machine direction and the cross-machine direction. The results are presented in Table 14.

TABLE 14

| Samples 52-57 | R (%) | A (%) | T (%) | MF (%) |
|---|---|---|---|---|
| Average (%) | 28.3 | 34.0 | 37.7 | 47.1 |
| Standard deviation (%) | 4.8 | 8.3 | 5.3 | 9.3 |
| Maximum (%) | 36 | 47 | 47 | 59 |
| Minimum (%) | 18 | 22 | 31 | 34 |

Samples 53-257 also were subjected to open load testing in a microwave ovens. Each of the samples sustained heating for a period of greater than 120 seconds without creating a fire.

Figure 4B:
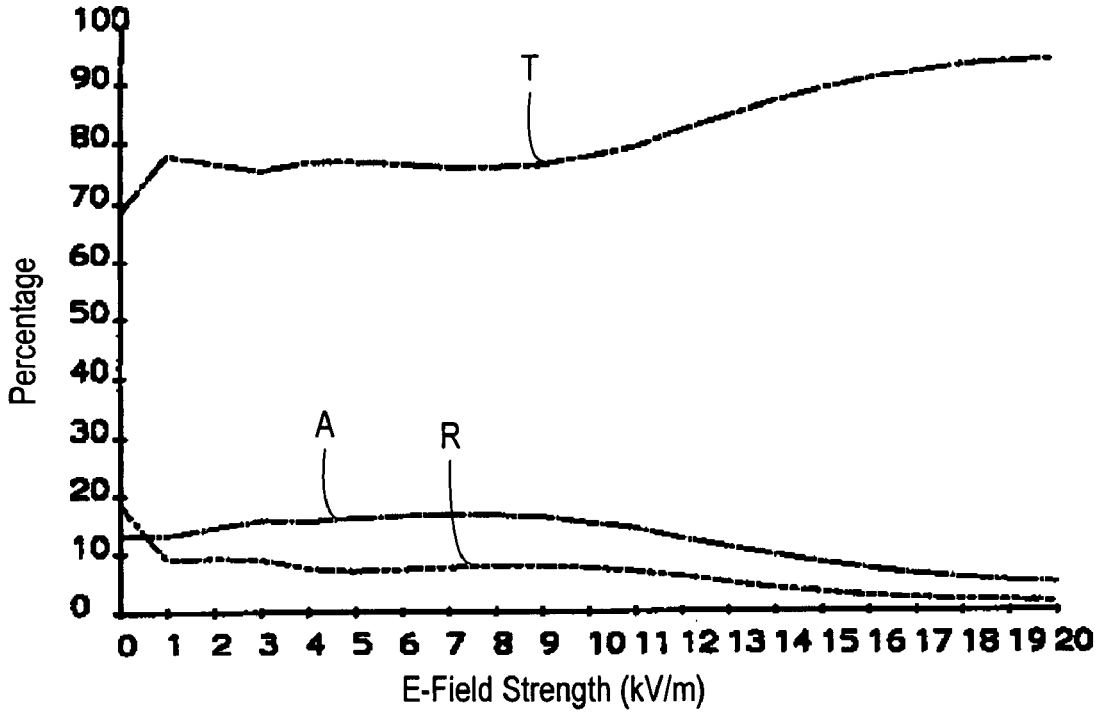
FIGS. 4B and 4C present the reflection-absorption-transmission characteristics of the arrangement of FIG. 4A under open load, high power conditions.
Figure 4C:
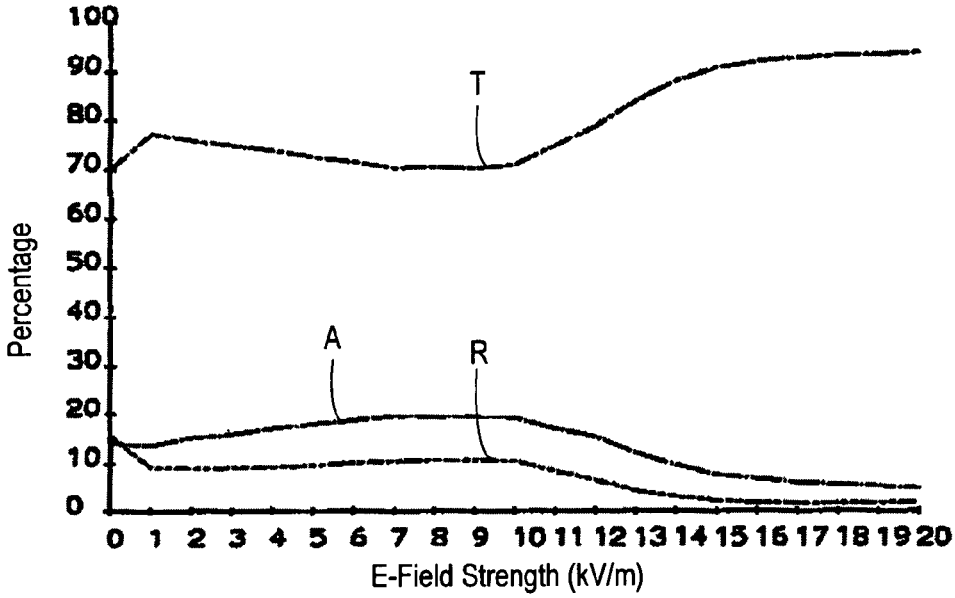

The structure also was evaluated to determine high power RAT characteristics. The results are presented in Table 15 and FIG. 4B (Sample 58, oriented in the machine direction), and Table 16 and FIG. 4C (Sample 59, oriented in the cross machine direction).

TABLE 15

| Sample | E-field strength (kV/m) | Incident energy | % Reflected | % Absorbed | % Transmitted |
|---|---|---|---|---|---|
| 58 | 0 | — | 18.5 | 13.1 | 68.4 |
| | 1 | 19.9 | 9.0 | 13.1 | 77.9 |
| | 2 | 32.4 | 9.3 | 14.5 | 76.5 |
| | 3 | 46.9 | 9.0 | 15.8 | 75.3 |
| | 4 | 70.5 | 7.5 | 15.7 | 76.7 |
| | 5 | 100.5 | 7.1 | 16.1 | 76.7 |
| | 6 | 138.7 | 7.3 | 16.5 | 76.2 |
| | 7 | 185.8 | 7.6 | 16.7 | 75.7 |
| | 8 | 241.0 | 7.8 | 16.5 | 75.7 |
| | 9 | 303.4 | 7.8 | 16.2 | 76.0 |
| | 10 | 370.7 | 7.4 | 15.2 | 77.4 |
| | 11 | 446.7 | 6.9 | 14.2 | 48.9 |
| | 12 | 528.4 | 6.0 | 12.4 | 81.7 |
| | 13 | 618.0 | 4.9 | 11.0 | 84.1 |
| | 14 | 714.5 | 3.9 | 9.6 | 86.5 |
| | 15 | 818.5 | 3.2 | 8.3 | 88.5 |
| | 16 | 931.1 | 2.6 | 7.2 | 90.2 |
| | 17 | 1049.5 | 2.2 | 6.3 | 91.4 |
| | 18 | 1177.6 | 1.9 | 5.6 | 92.5 |
| | 19 | 1309.2 | 1.8 | 5.1 | 93.1 |
| | 20 | 1452.1 | 1.7 | 4.8 | 93.5 |

TABLE 16

| Sample | E-field strength (kV/m) | Incident energy | % Reflected | % Absorbed | % Transmitted |
|---|---|---|---|---|---|
| 59 | 0 | — | 15.7 | 14.2 | 70.1 |
| | 1 | 20.5 | 9.3 | 13.7 | 77.1 |
| | 2 | 32.2 | 9.0 | 15.2 | 75.8 |
| | 3 | 46.9 | 9.2 | 16.0 | 74.8 |
| | 4 | 70.6 | 9.3 | 17.0 | 73.7 |
| | 5 | 100.7 | 9.6 | 18.0 | 72.4 |
| | 6 | 139.3 | 10.1 | 18.7 | 71.3 |
| | 7 | 188.8 | 10.3 | 19.5 | 70.1 |
| | 8 | 244.3 | 10.5 | 19.3 | 70.2 |
| | 9 | 307.6 | 10.6 | 19.4 | 70.0 |
| | 10 | 375.8 | 10.3 | 19.1 | 70.6 |
| | 11 | 450.8 | 8.4 | 17.0 | 74.6 |
| | 12 | 533.3 | 6.5 | 15.2 | 78.3 |
| | 13 | 619.4 | 4.4 | 12.0 | 83.6 |
| | 14 | 714.5 | 3.0 | 9.5 | 87.5 |

TABLE 16-continued

| Sample | E-field strength (kV/m) | Incident energy | % Reflected | % Absorbed | % Transmitted |
|---|---|---|---|---|---|
| | 15 | 816.6 | 2.2 | 7.6 | 90.2 |
| | 16 | 931.1 | 1.8 | 6.7 | 91.4 |
| | 17 | 1049.5 | 1.7 | 6.0 | 92.3 |
| | 18 | 1177.6 | 1.7 | 5.6 | 92.7 |
| | 19 | 1312.2 | 1.8 | 5.3 | 92.9 |
| | 20 | 1455.5 | 1.8 | 4.9 | 93.3 |

Example 5

Figure 5A:
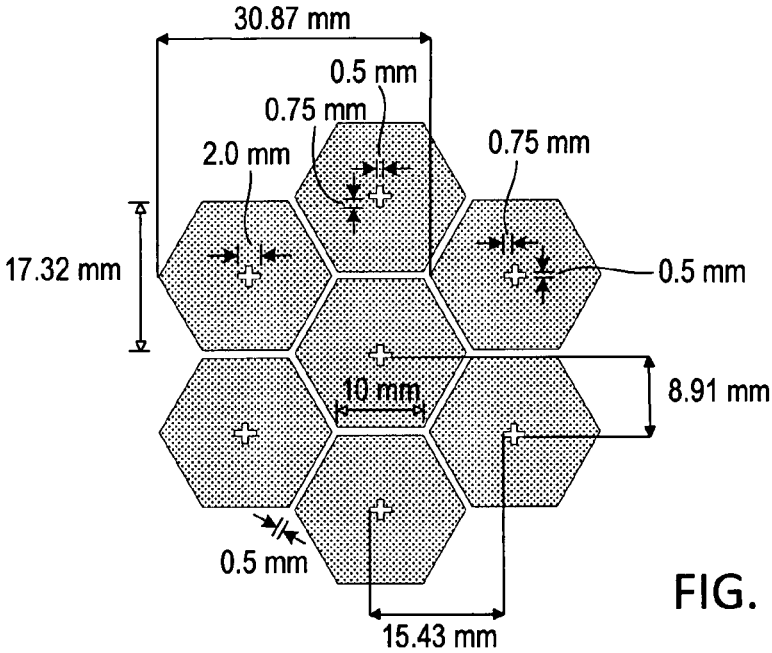
FIG. 5A schematically depicts yet another exemplary arrangement of microwave energy interactive and transparent elements, with approximate dimensions.

A susceptor film including a plurality of solid hexagons with centrally located cross-shaped inactive areas, substantially as shown schematically in FIG. 5A, having an optical density of about 0.26, was laminated to paper having a basis weight of about 35 lb/ream. The resulting structure then was evaluated to determine low power RAT characteristics. Six samples were tested in the machine direction and the cross-machine direction. The results are presented in Table 17.

TABLE 17

| Samples 60-65 | R (%) | A (%) | T (%) | MF (%) |
|---|---|---|---|---|
| Average (%) | 16.3 | 19.9 | 63.8 | 23.6 |
| Standard deviation (%) | 3.2 | 8.2 | 6.8 | 9.2 |
| Maximum (%) | 74 | 41 | 74 | 41 |
| Minimum (%) | 13 | 11 | 52 | 13 |

Samples 60-65 also were subjected to open load testing in a microwave ovens. Each of the samples sustained heating for a period of greater than 120 seconds without creating a fire.

Figure 5B:
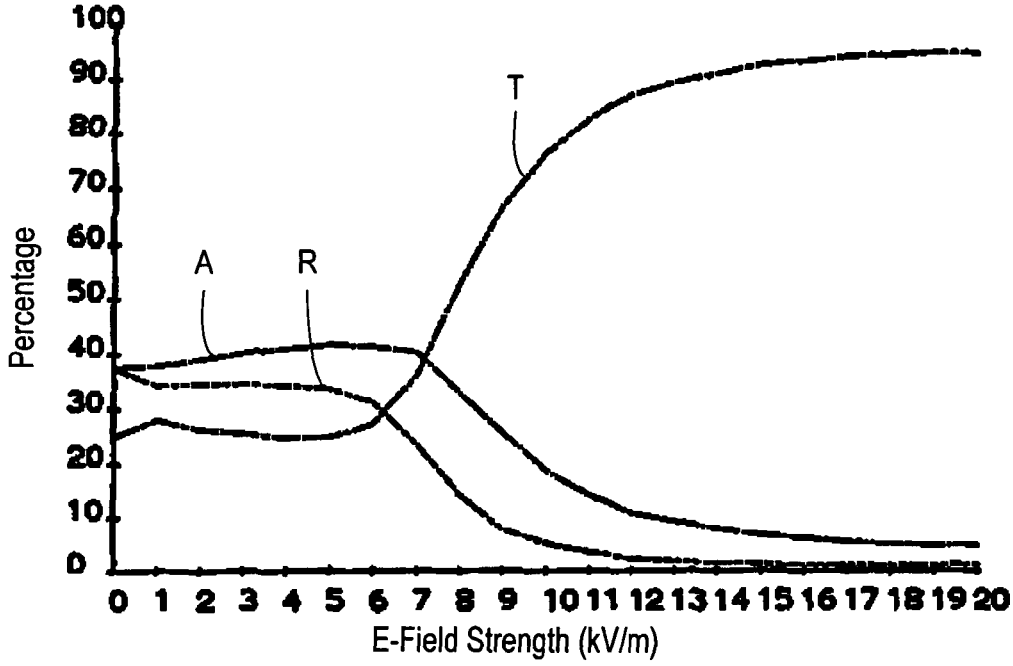
FIGS. 5B and 5C present the reflection-absorption-transmission characteristics of the arrangement of FIG. 5A under open load, high power conditions.
Figure 5C:
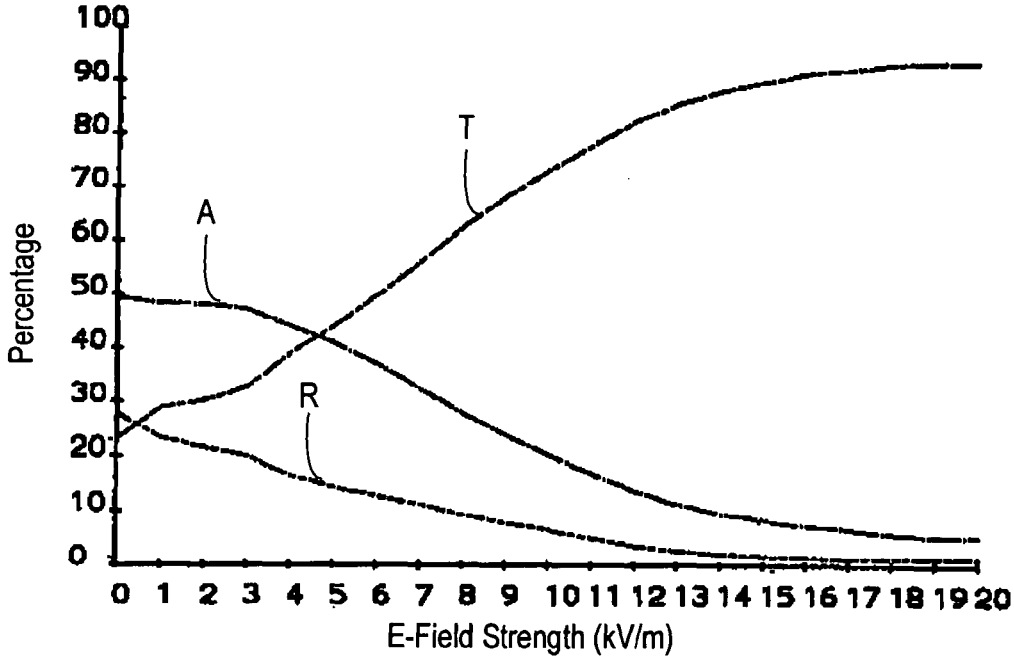

The structure also was evaluated to determine high power RAT characteristics. The results are presented in Table 18 and FIG. 5B (Sample 66, oriented in the machine direction), and Table 19 and FIG. 5C (Sample 67, oriented in the cross machine direction).

TABLE 18

| Sample | E-field strength (kV/m) | Incident energy | % Reflected | % Absorbed | % Transmitted |
|---|---|---|---|---|---|
| 66 | 0 | — | 37.4 | 37.6 | 25.0 |
| | 1 | 23.3 | 34.3 | 37.8 | 27.9 |
| | 2 | 35.0 | 34.6 | 39.1 | 26.3 |
| | 3 | 50.2 | 34.5 | 40.2 | 25.5 |
| | 4 | 76.2 | 34.3 | 41.1 | 24.8 |
| | 5 | 111.9 | 33.6 | 41.6 | 24.8 |
| | 6 | 154.5 | 31.3 | 41.4 | 27.3 |
| | 7 | 202.3 | 23.5 | 40.3 | 36.2 |
| | 8 | 252.9 | 14.3 | 32.9 | 52.9 |
| | 9 | 311.9 | 7.8 | 25.6 | 66.7 |
| | 10 | 375.8 | 5.2 | 18.7 | 76.1 |
| | 11 | 450.8 | 3.5 | 14.1 | 82.4 |
| | 12 | 533.3 | 2.4 | 10.9 | 86.7 |
| | 13 | 622.3 | 1.8 | 9.2 | 88.9 |
| | 14 | 719.4 | 1.5 | 7.9 | 90.6 |
| | 15 | 824.1 | 1.3 | 6.7 | 92.1 |
| | 16 | 939.7 | 1.1 | 6.2 | 92.7 |
| | 17 | 1056.8 | 1.1 | 5.3 | 93.5 |
| | 18 | 1185.8 | 1.1 | 5.1 | 93.8 |
| | 19 | 1321.3 | 1.1 | 4.7 | 94.2 |
| | 20 | 1468.9 | 1.2 | 4.8 | 94.0 |

TABLE 19

| Sample | E-field strength (kV/m) | Incident energy | % Reflected | % Absorbed | % Transmitted |
|---|---|---|---|---|---|
| 67 | 0 | — | 27.7 | 49.3 | 23.0 |
| | 1 | 21.5 | 23.3 | 48.4 | 28.8 |
| | 2 | 33.8 | 21.6 | 48.2 | 30.2 |
| | 3 | 48.3 | 20.1 | 47.2 | 32.7 |
| | 4 | 73.1 | 16.6 | 44.3 | 39.1 |
| | 5 | 104.5 | 14.5 | 41.1 | 44.2 |
| | 6 | 143.5 | 12.9 | 37.2 | 49.9 |
| | 7 | 191.9 | 11.4 | 32.6 | 56.0 |
| | 8 | 246.6 | 9.5 | 27.9 | 62.5 |
| | 9 | 308.3 | 7.9 | 23.9 | 68.2 |
| | 10 | 375.0 | 6.5 | 20.4 | 73.1 |
| | 11 | 449.8 | 5.1 | 17.0 | 78.0 |
| | 12 | 532.1 | 3.7 | 13.9 | 82.4 |
| | 13 | 620.9 | 2.8 | 11.5 | 85.7 |
| | 14 | 717.8 | 2.1 | 9.8 | 88.1 |
| | 15 | 822.2 | 1.7 | 8.5 | 89.7 |
| | 16 | 935.4 | 1.5 | 7.3 | 91.2 |
| | 17 | 1054.4 | 1.4 | 6.6 | 92.0 |
| | 18 | 1183.0 | 1.4 | 5.8 | 92.9 |
| | 19 | 1315.2 | 1.4 | 5.3 | 93.3 |
| | 20 | 1462.2 | 1.4 | 5.3 | 93.3 |

Example 6

Various structures were prepared for evaluation and comparison, as set forth in Table 20.

TABLE 20

| Structure | Description |
|---|---|
| Plain paper | Plain susceptor film having an optical density of about 0.26, laminated to paper having a basis weight of about 35 lb/ream (lb/3000 sq. ft.) |

TABLE 20-continued

| Structure | Description |
|---|---|
| Plain board | Plain susceptor film having an optical density of about 0.26, laminated to paperboard having a caliper of about 23.5 pt (about 247 lb/ream) |
| Cross paper | Susceptor film with a simple cross pattern, as shown in FIG. 3A, laminated to paper having a basis weight of about 35 lb/ream |
| Cross board | Susceptor film with a simple cross pattern, as shown in FIG. 3A, laminated to paperboard having a caliper of about 14.5 pt (about 152 lb/ream) |
| Hex fuse paper | Exemplary susceptor film according to various aspects of the invention, as shown in FIG. 1D, laminated to paper having a basis weight of about 35 lb/ream |
| Hex fuse board | Exemplary susceptor film according to various aspects of the invention, as shown in FIG. 1D, laminated to paperboard having a caliper of about 23.5 pt (about 247 lb/ream) |

First, several samples were oriented in the machine direction and evaluated to determine low power RAT characteristics and merit factor. Next, several samples, were subjected to open load abuse testing in a 1200 W microwave oven. After the open load testing, several samples again were evaluated for low power RAT characteristics and merit factor to determine the loss in overall efficacy of the susceptor. Finally, several samples were selected for image analysis testing. The results of the various evaluations are presented in Table 21.

In general, when comparing the MF before and after the 10 second open load abuse test, the hex fuse paper outperformed the cross paper susceptor and the plain paper susceptor. Furthermore, viewing the percent crack area and the average crack length per unit area, it is evident that the hex fuse paper was less susceptible to crazing than the cross paper susceptor and the plain paper susceptor.

TABLE 21

| Description | | | Low power RAT - before open load abuse test | | | | Open load | Low power RAT - after open load abuse test | | | | Image analysis | | | | |
|---|---|---|---|---|---|---|---|---|---|---|---|---|---|---|---|---|
| Sample | Susceptor | Paper/board | R (%) | A (%) | T (%) | MF (%) | Time (s) | R (%) | A (%) | T (%) | MF (%) | A (%) | SD (%) | L (mm) | W (mm) | L/A (mm/sq. cm) |
| 68 | Hex fuse | Paper | 49.4 | 41.2 | 9.4 | 81.4 | 10 | 3.5 | 1.5 | 95.1 | 1.5 | 0.38 | 0.23 | 0.32 | 0.048 | 4.6 |
| 69 | Hex fuse | Paper | 45.6 | 44.1 | 10.3 | 81.1 | 10 | 2.3 | −0.1 | 97.7 | −0.1 | 0.26 | 0.24 | 0.24 | 0.039 | 3.0 |
| 70 | Cross | Paper | 38.2 | 48.0 | 13.8 | 77.6 | 10 | 2.2 | −1.0 | 98.9 | −1.1 | 4.2 | 1.0 | 0.32 | 0.052 | 59.0 |
| 71 | Cross | Paper | 34.0 | 49.4 | 16.5 | 75.0 | 10 | 2.8 | −0.3 | 97.5 | −0.3 | 2.8 | 1.1 | 0.33 | 0.051 | 39.8 |
| 72 | Plain | Paper | 51.4 | 35.0 | 13.6 | 72.1 | 10 | 3.7 | 0.3 | 95.9 | 0.3 | — | — | — | — | — |
| 73 | Plain | Paper | 40.5 | 46.7 | 12.8 | 78.5 | 10 | 4.4 | 1.5 | 94.2 | 1.5 | 4.6 | 4.0 | 0.72 | 0.049 | 71.6 |
| 74 | Plain | Paper | 31.3 | 48.1 | 20.6 | 70.0 | 10 | 1.7 | −1.0 | 99.3 | −1.0 | 7.7 | 2.9 | 0.38 | 0.060 | 95.3 |
| 75 | Hex fuse | Paper | 51.8 | 39.6 | 8.6 | 82.1 | 20 | 3.0 | 0.8 | 96.2 | 0.8 | — | — | — | — | — |
| 76 | Hex fuse | Paper | 44.5 | 44.7 | 10.8 | 80.5 | 20 | 2.1 | 0.4 | 97.5 | 0.4 | — | — | — | — | — |
| 77 | Plain/ Hex fuse | Paper/ Paper | 40.0 | 52.1 | 7.9 | 86.8 | 20 | 3.6 | 0.7 | 95.7 | 0.7 | — | — | — | — | — |
| 78 | Hex fuse | Board | 45.3 | 46.4 | 8.3 | 84.8 | 20 | 11.6 | 6.9 | 81.5 | 7.8 | 3.8 | 2.4 | 0.95 | 0.050 | 49.9 |
| 79 | Cross | Paper | 30.5 | 50.2 | 19.2 | 72.3 | 20 | 2.6 | −0.8 | 98.2 | −0.8 | — | — | — | — | — |
| 80 | Cross | Paper | 25.6 | 50.2 | 24.2 | 67.5 | 20 | 1.8 | −0.9 | 99.1 | −0.9 | — | — | — | — | — |
| 81 | Cross | Board | 35.9 | 48.3 | 15.8 | 75.4 | 20 | — | — | — | — | 6.7 | 3.3 | 0.48 | 0.059 | 83.6 |
| 82 | Plain | Paper | 47.4 | 44.4 | 8.2 | 84.4 | 20 | 3.1 | −0.4 | 97.3 | −0.4 | — | — | — | — | — |
| 83 | Plain | Paper | 40.1 | 47.0 | 12.9 | 78.4 | 20 | 2.3 | −0.7 | 98.4 | −0.8 | — | — | — | — | — |
| 84 | Plain | Paper | 48.3 | 42.2 | 9.5 | 81.7 | 20 | 2.2 | −1.2 | 99.1 | −1.3 | — | — | — | — | — |
| 85 | Plain | Board | 48.8 | 41.8 | 9.4 | 81.6 | 20 | 13.9 | 10.9 | 75.2 | 12.7 | 5.4 | 2.5 | 0.55 | 0.044 | 78.8 |

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the invention as set forth in the following claims.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A susceptor structure comprising:

a plurality of microwave energy transparent segments spaced apart within a layer of microwave energy interactive material, the layer of microwave energy interactive material comprising a susceptor that is operative for converting microwave energy to thermal energy, wherein the plurality of microwave energy transparent segments define interconnected resonant loops having a peripheral length configured to induce resonance of microwave energy along the interconnected resonant loops within the layer of microwave energy interactive material; and a substantially cross-shaped microwave energy transparent element disposed within each loop of the interconnected resonant loops, wherein the plurality of microwave energy transparent segments that define the interconnected resonant loops and the substantially cross-shaped microwave energy transparent element disposed within each loop of the interconnected resonant loops are circumscribed by the microwave energy interactive material.

2. The susceptor structure of claim 1, wherein each loop of the interconnected resonant loops is substantially hexagonal in shape.

3. The susceptor structure of claim 1, wherein the microwave energy transparent segments defining each loop of the interconnected resonant loops include side segments and corner segments.

4. The susceptor structure of claim 3, wherein the side segments have a substantially rectangular shape.

5. The susceptor structure of claim 3, wherein the side segments have a first dimension of about 2 mm.

6. The susceptor structure of claim 5, wherein the side segments have a second dimension of about 0.5 mm.

7. The susceptor structure of claim 3, wherein the corner segments have a substantially tri-star shape.

8. The susceptor structure of claim 1, wherein the substantially cross-shaped microwave energy transparent element comprises a pair of orthogonally overlapping, substantially rectangular microwave energy transparent segments.

9. The susceptor structure of claim 8, wherein the substantially rectangular microwave energy transparent segments of the substantially cross-shaped microwave energy transparent element each have a first dimension of about 2 mm and a second dimension of about 0.5 mm.

10. The susceptor structure of claim 1, wherein the substantially cross-shaped microwave energy transparent element disposed within each loop of the interconnected resonant loops is substantially centered within the respective loop of the interconnected resonant loops.

11. The susceptor structure of claim 1, wherein the peripheral length of each loop of the interconnected resonant loops is about 60 mm.

12. The susceptor structure of claim 1, wherein the peripheral length of each loop of the interconnected resonant loops is approximately equal to one-half of an effective wavelength of microwaves in an operating microwave oven.

13. The susceptor structure of claim 1, wherein at least some loops of the interconnected resonant loops have a substantially hexagonal shape dimensioned to promote resonance of microwave energy across the susceptor structure.

14. The susceptor structure of claim 1, wherein the microwave energy interactive material comprises aluminum, the substantially cross-shaped microwave energy transparent element has a first overall dimension of about 2 mm and a second overall dimension of about 2 mm, and the peripheral length of each loop of the interconnected resonant loops is about 60 mm.

15. The susceptor structure of claim 1, wherein each loop of the interconnected resonant loops has a substantially hexagonal shape, the peripheral length of each loop of the plurality of interconnected resonant loops is about 60 mm, the plurality of microwave energy transparent segments defining the interconnected resonant loops includes side segments and corner segments, the side segments each having a first dimension of about 2 mm and a second dimension of about 0.5 mm, and the corner segments each being substantially tri-star in shape, and the substantially cross-shaped microwave energy transparent element disposed within each loop of the interconnected loops has a first overall dimension of about 2 mm and a second overall dimension of about 2 mm.

16. The susceptor structure of claim 1, wherein each loop of the interconnected resonant loops has a plurality of sides, wherein each side has a length of about 10 mm.

17. A susceptor structure comprising:

a plurality of microwave energy transparent segments within a layer of microwave energy interactive material, the layer of microwave energy interactive material comprising a susceptor that is operative for converting microwave energy to thermal energy, wherein the plurality of microwave energy transparent segments are arranged as a pattern of interconnected hexagonal loops; and a substantially cross-shaped microwave energy transparent element substantially centered within each hexagonal loop of the interconnected hexagonal loops.

18. The susceptor structure of claim 17, wherein the plurality of microwave energy transparent segments includes segments that form sides of each hexagonal loop and segments that form corners of each hexagonal loop.

19. The susceptor structure of claim 18, wherein the segments that form sides of each hexagonal loop have a first dimension of about 2 mm and a second dimension of about 0.5 mm, the segments that form corners of each hexagonal loop are substantially tri-star in shape, the substantially cross-shaped microwave energy transparent element within each hexagonal loop has a first overall dimension of about 2 mm and a second overall dimension of about 2 mm, and each hexagonal loop has a peripheral length of about 60 mm.

20. The susceptor structure of claim 17, wherein each hexagonal loop of the interconnected hexagonal loops has a plurality of sides, wherein each side has a length of about 10 mm.

21. A susceptor structure comprising:

an electrically continuous layer of conductive material supported on a non-conductive substrate, the conductive material comprising a susceptor that is operative for converting microwave energy to thermal energy, wherein the susceptor structure includes a repeating pattern of microwave energy transparent areas within the layer of conductive material, the microwave energy transparent areas being circumscribed by the conductive material, the repeating pattern includes a plurality of cross-shaped microwave energy transparent elements and a plurality of microwave energy transparent, segmented hexagonal loops, each cross-shaped microwave energy transparent element being disposed within a respective one of the segmented hexagonal loops, and at least some of the segmented hexagonal loops have a peripheral length configured to promote resonance of microwave energy across the susceptor structure.

22. The susceptor structure of claim 21, wherein the electrically continuous layer of conductive material comprises aluminum, the non-conductive substrate comprises a polymer film, the cross-shaped microwave energy transparent elements each have a first overall dimension of about 2 mm and a second overall dimension of about 2 mm, and the peripheral length of at least some of the segmented hexagonal loops is about 60 mm.

23. The susceptor structure of claim 21, wherein the segmented hexagonal loops each have a plurality of sides, wherein each side has a length of about 10 mm.

24. A susceptor structure comprising:

a susceptor supported on a non-conductive substrate, the susceptor being operative for converting microwave energy to thermal energy, wherein the susceptor circumscribes both a plurality of microwave energy transparent areas that define interconnected resonant loops, each loop of the interconnected resonant loops having a peripheral length configured to induce resonance of microwave energy along the interconnected resonant loops within the susceptor, and a pair of orthogonally overlapping, substantially rectangular microwave energy transparent segments within each loop of the interconnected resonant loops.

25. The susceptor structure of claim 24, wherein the peripheral length of each loop of the interconnected resonant loops is about 60 mm.

26. The susceptor structure of claim 24, wherein the interconnected resonant loops are dimensioned to promote resonance of microwave energy across the susceptor structure.

27. The susceptor structure of claim 24, wherein each loop of the interconnected resonant loops is substantially hexagonal in shape.

28. The susceptor structure of claim 27, wherein the microwave energy transparent areas that define each loop of the interconnected resonant loops include side areas and corner areas.

29. The susceptor structure of claim 28, wherein the side areas have a substantially rectangular shape.

30. The susceptor structure of claim 28, wherein the corner areas have a substantially tri-star shape.

31. The susceptor structure of claim 24, wherein the peripheral length of each loop of the interconnected resonant loops is approximately equal to one-half of an effective wavelength of microwaves in an operating microwave oven.

32. The susceptor structure of claim 24, wherein each loop of the interconnected resonant loops has a substantially hexagonal shape, the peripheral length of each loop of the interconnected resonant loops is about 60 mm, and the microwave energy transparent areas defining each loop of the interconnected resonant loops include side areas and corner areas, the side areas each having a first dimension of about 2 mm and a second dimension of about 0.5 mm, and the corner areas each being substantially tri-star in shape.

33. The susceptor structure of claim 24, wherein each loop of the interconnected resonant loops has a plurality of sides, wherein each side has a length of about 10 mm.

34. A susceptor structure comprising:

a layer of conductive material supported on a non-conductive substrate, the layer of conductive material circumscribing a plurality of microwave energy transparent areas that define a plurality of interconnected resonant loops and a plurality of substantially cross-shaped elements, the substantially cross-shaped elements each being disposed within a respective one of the interconnected resonant loops, wherein the plurality of microwave energy transparent areas that define the interconnected resonant loops include side areas and corner areas, the corner areas having a substantially tri-star shape, the layer of conductive material comprises a susceptor that is operative for converting microwave energy to thermal energy, and the interconnected resonant loops have a peripheral length configured to induce resonance along the interconnected resonant loops.

35. The susceptor structure of claim 34, wherein each loop of the plurality of interconnected resonant loops is substantially hexagonal in shape.

36. The susceptor structure of claim 34, wherein the peripheral length of each loop of the plurality of interconnected resonant loops is approximately equal to one-half of an effective wavelength of microwaves in an operating microwave oven.

37. The susceptor structure of claim 34, wherein each loop of the plurality of interconnected resonant loops is dimensioned to promote resonance of microwave energy across the susceptor structure.

38. The susceptor structure of claim 34, wherein the side areas have a substantially rectangular shape.

39. The susceptor structure of claim 34, wherein the side areas each have a first dimension of about 2 mm and a second dimension of about 0.5 mm.

40. The susceptor structure of claim 34, wherein each substantially cross-shaped element of the plurality of substantially cross-shaped elements is substantially centered within each loop of the plurality of interconnected resonant loops.

41. The susceptor structure of claim 34, wherein each cross-shaped microwave element of the plurality of substantially cross-shaped elements has a first overall dimension of about 2 mm and a second overall dimension of about 2 mm.

42. The susceptor structure of claim 34, wherein each loop of the plurality of interconnected resonant loops has a plurality of sides, wherein each side has a length of about 10 mm.

43. A susceptor structure comprising:

a layer of conductive material supported on a non-conductive substrate, the conductive layer including a plurality of spaced apart microwave energy transparent segments that define a pattern of interconnected hexagonal loops, and a substantially centrally located microwave energy transparent element within at least one of the loops.

44. The susceptor structure of claim 43, wherein the plurality of spaced apart microwave energy transparent segments includes side segments and corner segments.

45. The susceptor structure of claim 44, wherein the side segments have a substantially rectangular shape.

46. The susceptor structure of claim 44, wherein the side segments have a first dimension of about 2 mm.

47. The susceptor structure of claim 46, wherein the side segments have a second dimension of about 0.5 mm.

48. The susceptor structure of claim 44, wherein the corner segments have a substantially tri-star shape.

49. The susceptor structure of claim 43 wherein the substantially centrally located microwave energy transparent element has a substantially cross shape.

50. The susceptor structure of claim 49, wherein the substantially centrally located microwave energy transparent element comprises a pair of orthogonally overlapping, substantially rectangular microwave energy transparent segments.

51. The susceptor structure of claim 50, wherein each substantially rectangular microwave energy transparent segments of the pair of orthogonally overlapping, substantially rectangular microwave energy transparent segments has a first dimension of about 2 mm and a second dimension of about 0.5 mm.

52. The susceptor structure of claim 43, wherein the interconnected hexagonal loops have a peripheral length for promoting resonance of microwave energy along the interconnected hexagonal loops.

53. The susceptor structure of claim 43, wherein the interconnected hexagonal loops have a peripheral length for promoting resonance of microwave energy across the susceptor structure.

54. The susceptor structure of claim 43, wherein each loop of the interconnected hexagonal loops has a peripheral length approximately equal to one-half of an effective wavelength of an operating microwave oven.

55. The susceptor structure of claim 54, wherein the peripheral length of at least some loops of the interconnected hexagonal loops is about 60 mm.

56. The susceptor structure of claim 54, wherein the conductive material comprises aluminum, the substantially centrally located microwave energy transparent element has a first overall dimension of about 2 mm and a second overall dimension of about 2 mm, and the peripheral length of at least some loops of the interconnected hexagonal loops is about 60 mm.

57. The susceptor structure of claim 43, wherein at least some loops of the interconnected hexagonal loops have a peripheral length of about 60 mm, the microwave energy transparent segments that define the pattern of interconnected hexagonal loops include side segments and corner segments, the side segments each having a first dimension of about 2 mm and a second dimension of about 0.5 mm, the corner segments each being substantially tri-star in shape, and the substantially centrally located microwave energy transparent element within the at least one of the loops has a first overall dimension of about 2 mm and a second overall dimension of about 2 mm.

58. The susceptor structure of claim 43, wherein each loop of the interconnected hexagonal loops has a plurality of sides, wherein each side has a length of about 10 mm.

* * * * *